United States Patent [19]

Ikeda et al.

[11] Patent Number: 4,917,997

[45] Date of Patent: Apr. 17, 1990

[54] SILVER HALIDE PHOTOGRAPHIC EMULSION

[75] Inventors: Tadashi Ikeda; Haruo Takei, both of Kanagawa, Japan

[73] Assignee: Fuji Photo Film Co., Ltd., Kanagawa, Japan

[21] Appl. No.: 246,569

[22] Filed: Sep. 12, 1988

[30] Foreign Application Priority Data

Sep. 11, 1987 [JP] Japan ..... 62-227905

[51] Int. Cl.[4] ..... G03C 1/28

[52] U.S. Cl. ..... 430/572; 430/573; 430/577; 430/578; 430/592; 430/600; 430/613; 430/614

[58] Field of Search ..... 430/613, 614, 576, 577, 430/578, 584, 586, 587, 572, 573, 600, 574, 592

[56] References Cited

U.S. PATENT DOCUMENTS

| | | | |
|---|---|---|---|
| 3,695,888 | 10/1972 | Hiller et al. | 430/566 |
| 3,809,561 | 5/1974 | Ulbing et al. | 430/606 |
| 4,536,473 | 8/1985 | Mihara | 430/575 |
| 4,596,767 | 6/1986 | Mihara et al. | 430/576 |
| 4,677,053 | 6/1987 | Mihara et al. | 430/576 |
| 4,770,961 | 9/1988 | Tanaka et al. | 430/578 |
| 4,822,726 | 4/1989 | Ikeda et al. | 430/550 |

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A silver halide photographic emulsion comprising a silver halide emulsion, at least one ascorbic acid compound, a bisaminostilbene compound substituted by a pyrimidine derivative, and at least one sensitizing dye as described herein, exhibits an increased inhibition of desensitization due to the use of a sensitizing dye and an increase in the spectral sensitivity of the photographic emulsion.

3 Claims, No Drawings

SILVER HALIDE PHOTOGRAPHIC EMULSION

FIELD OF THE INVENTION

The present invention relates to a spectrally sensitized silver halide photographic emulsion. More particularly, the present invention relates to an improvement in the inhibition of desensitization caused by a sensitizing dye.

BACKGROUND OF THE INVENTION

Spectral sensitization is an extremely important and indispensable technique in the preparation of a light-sensitive material having a high sensitivity and an excellent color reproducibility. A spectral sensitizing dye is inherently adapted to absorb light in a long wavelength range which is not substantially absorbed by a silver halide photographic emulsion to transfer the light energy to the silver halide. Accordingly, the expansion of the light-sensitive wavelength range and increase of the photographic sensitivity by such a spectral sensitizing agent is an essential technology. Thus, attempts have been made to increase the captured amount of light by increasing the amount of spectral sensitizing agent added to the silver halide emulsion. However, if the spectral sensitizing dye is added to the silver halide emulsion in excess of the optimum amount, it may cause a great desensitization. This phenomenon, generally known as dye sensitization, occurs when desensitization takes place in the inherent light-sensitive range of silver halide in which no light is absorbed by the sensitizing dye. A great desensitization deteriorates the total sensitivity despite its spectral sensitizing effect. In other words, a decrease in the dye desensitization accordingly causes an increase in the sensitivity in the range of light absorption by the sensitizing dye (i.e., spectral sensitivity). Thus, improvement in the inhibition of dye desensitization is of central importance in the spectral sensitization process. Furthermore, the dye desensitization becomes remarkable for a sensitizing dye having a light-sensitive range in a longer wavelength range. This is further described in C. E. K. Mees, *The Theory of the Photographic Process*, Macmillan, 1942, pp. 1067–1069.

In order to increase the sensitivity by decreasing the dye desensitization, various approaches are disclosed in JP-A-47-28916, 49-46738 and 54-118236 (the term "JP-A" as used herein refers to an "unexamined published Japanese patent application") and U.S. Pat. No. 4,011,083 which suggest the use of acetylene-silver complexes, pyrazolone compounds, N-aminoimmonium compounds, N-imine compounds or azaindene-silver complexes. Other approaches are disclosed in JP-B-45-22189 (British Pat. No. 1,211,735) (the term "JP-B" as used herein refers to an "examined Japanese patent publication"), JP-A-46-550 (U.S. Pat. No. 3,615,613), JP-A-54-18726 (U.S. Pat. No. 4,212,672), JP-A-52-4822 (U.S. Pat. No. 4,046,572) and JP-A-52-151026 and U.S. Pat. No. 2,945,762 which suggest the combined use of a bisaminostilbene compound substituted by a pyrimidine derivative or triazine derivative. These approaches are now deemed to be the most effective method. Further approaches are disclosed in U.S. Pat. Nos. 3,695,888 and 3,809,561 and British Pat. Nos. 1,064,193 and 1,255,084 which suggest the combined use of a bisaminostilbene compound substituted by a triazine derivative and ascorbic acid compound. In accordance with these patents, this process improves the inhibition of the dye desensitization, providing a high sensitivity. However, these approaches have proved inadequate in their effects. Thus, it has been desired to further improve the dye sensitivity.

As a result of intensive studies, the inventors found that the combined use of an ascorbic acid compound and a bisaminostilbene compound substituted by a pyrimidine derivative inhibits desensitization caused by a red-sensitive sensitizing dye, thus providing a remarkably high increase in red dye sensitivity.

SUMMARY OF THE INVENTION

It is, therefore, an object of the present invention to provide a silver halide photographic emulsion which exhibits an improvement in the inhibition of dye desensitization and hence an improved sensitivity.

It is another object of the present invention to provide a silver halide photographic emulsion having excellent storage stability.

It is further object of the present invention to provide a silver halide photographic emulsion which exhibits less residual color due to a sensitizing dye.

These and other objects of the present invention will become more apparent from the following detailed description and examples.

These objects of the present invention are accomplished with a silver halide photographic emulsion, which comprises at least one ascorbic acid compound, at least one compound represented by general formula (I), and at least one sensitizing dye represented by general formulae (II) and (III).

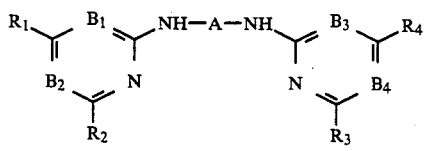

(I)

wherein A represents a divalent aromatic residual group; $R_1$, $R_2$, $R_3$ and $R_4$ each independently represents a hydrogen atom, a hydroxyl group, an alkyl group, an alkoxy group, an aryloxyl group, a halogen atom, a heterocyclic nucleus, an allylthio group, a heterocyclylthio group, an arylthio group, an amino group, a substituted or unsubstituted alkylamino group, a substituted or unsubstituted arylamino group, a heterocyclylamino group, or a substituted or unsubstituted aralkylamino group, a substituted or unsubstituted aryl group or a mercapto group; and $B_1$, $B_2$, $B_3$ and $B_4$ each represents —CH= or —N=, with the provisos that at least one of A, $R_1$, $R_2$, $R_3$ and $R_4$ contains a sulfonyl group, that one of $B_1$ and $B_2$ represents —CH= and the other represents —N=, and that one of $B_3$ and $B_4$ represents —CH= and the other represents —N=.

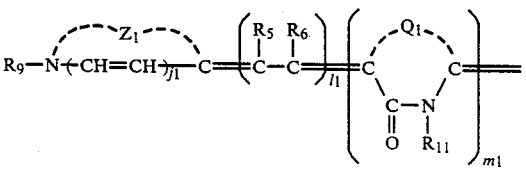

(II)

-continued

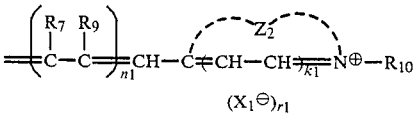

wherein $Z_1$ and $Z_2$, which may be the same or different, each represents a 5- or 6-membered nitrogen-containing heterocycle-forming atomic group; $Q_1$ represents a 5- or 6-membered nitrogen-containing ketomethylene ring-forming atomic group; $R_5$, $R_6$, $R_7$ and $R_8$ each independently represents a hydrogen atom, a lower alkyl group, or a phenyl group or an aralkyl group either or both of which may be substituted; $R_9$ and $R_{10}$ each independently represents an alkyl group or an alkenyl group, either of which may contain one or more oxygen atoms, sulfur atoms and/or nitrogen atoms in the carbon chain and which may be substituted; $R_{11}$ has the same meaning as $R_9$ or represents an aryl group or a 5- or 6-membered heterocyclic group; $l_1$ and $n_1$ each represents an integer of 0 to 3, with the provisos that $(l_1-n_1)$ represents 1, 2 or 3, and that when $l_1$ is 1, 2 or 3, $R_5$ and $R_9$ may be connected to each other to form, together with the adjacent atoms, a 5- or 6-membered ring, and that when $l_1$ represents 2 to 3 and $n_1$ represents 2 or 3, two $R_5$'s, two $R_6$'s, two $R_7$'s or two $R_8$'s may be connected to each other to form, together with the adjacent atoms, a 5- or 6-membered ring which may contain one or more oxygen atoms, sulfur atoms and/or nitrogen atoms; $j_1$, $k_1$ and $m_1$ each independently represents 0 or 1; $X_1^{\ominus}$ represents an acid anion; and $r_1$ represents an integer of 0 or 1.

(III)

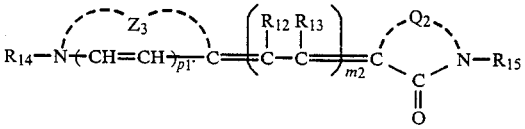

wherein $Z_3$ represents a 5- or 6-membered nitrogen-containing heterocycle-forming atomic group; $Q_2$ represents a 5- or 6-membered nitrogen-containing ketomethylene ring-forming atomic group; $R_{12}$ represents a hydrogen atom or an alkyl group; $R_{13}$ represents a hydrogen atom or a phenyl group or an alkyl group either or both of which may be substituted; $R_{14}$ represents an alkyl or alkenyl group which may contain one or more oxygen atoms, sulfur atoms and/or nitrogen atoms in the carbon chain or may be substituted; $R_{15}$ has the same meaning as $R_{14}$, or represents a hydrogen atom or a monocyclic aryl group or a 5- or 6-membered monoheterocyclic group either or both of which may be substituted; $m_2$ represents an integer of 2 or 3 with the proviso that two $R_{13}$'s may be connected to each other to form a 5- or 6-membered ring which may contain one or more oxygen atoms, sulfur atoms and/or nitrogen atoms; and $p_1$ represents an integer of 0 or 1, with the proviso that $R_{12}$ and $R_{14}$ may be connected to each other to form, together with the adjacent atoms, a 5- or 6-membered ring.

DETAILED DESCRIPTION OF THE INVENTION

The compounds which can be used in the present invention will be further described hereinafter.

(I)

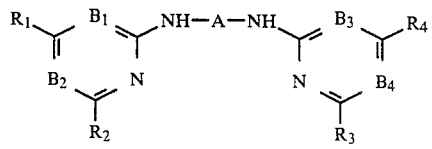

In general formula (I), —A— represents a divalent aromatic residual group which may contain an $-SO_3M$ group in which M represents a hydrogen atom or a solubilizing cation.

As —A—, there may be preferably used one group selected from the group consisting of $-A_1-$ and $-A_2-$. However, if any of $R_1$, $R_2$, $R_3$ or $R_4$ does not contain $-SO_3M$, —A— is selected from the group consisting of $-A_1-$.

-A1-:

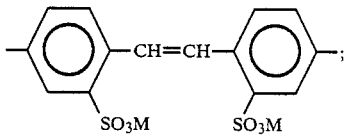

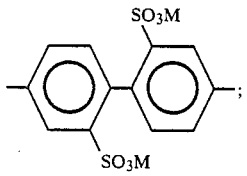

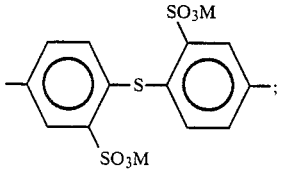

-continued

-A1-:

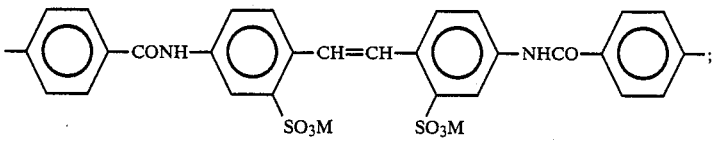

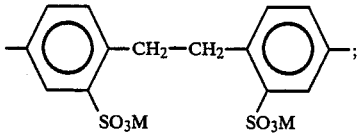

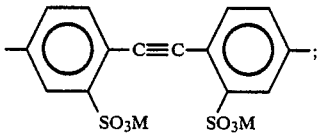

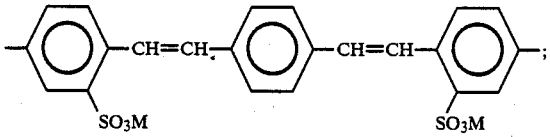

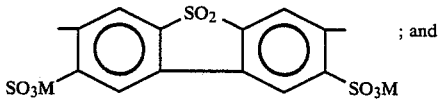

; and

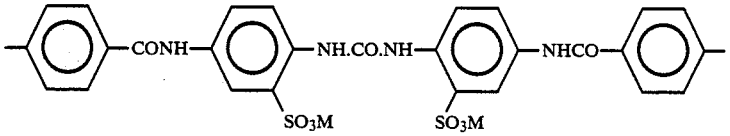

wherein M represents a hydrogen atom or a solubilizing cation.

-A2-:

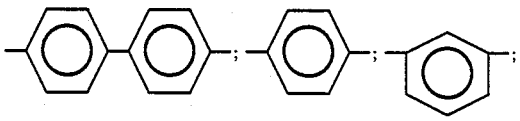

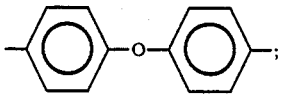

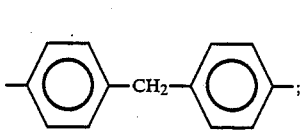

; and

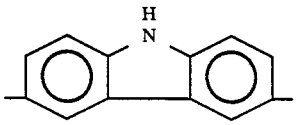

$R_1$, $R_2$, $R_3$ and $R_4$ each independently represents a hydrogen atom, a hydroxyl group, a lower alkyl group which preferably contains from 1 to 8 carbon atoms (e.g., methyl, ethyl, n-propyl, n-butyl); an alkoxyl group which preferably contains from 1 to 8 carbon atoms (e.g., methoxy, ethoxyl, propoxyl, butoxyl); and aryloxyl group (e.g., phenoxyl, naphthoxyl, o-tolyloxyl, p-sulfophenoxyl); a halogen atom (e.g., chlorine, bromine); a heterocyclic nucleus (e.g., morpholinyl, piperidyl); an alkylthio group (e.g., methylthio, ethylthio); a heterocyclylthio group (e.g., benzothiazolylthio, benzimidazolylthio, phenyltetrazolylthio); an arylthio group (e.g., phenylthio, tolylthio); an amino group; an alkylamino group or a substituted alkylamino group (e.g., methylamino, ethylamino, propylamino, dimethylamino, diethylamino, dodecylamino, cyclohexylamino, β-hydroxyethylamino, di(β-hydroxyethyl-)amino, β-sulfoethylamino); an arylamino group or a substituted arylamino group (e.g., anilino, o-sulfoanilino, m-sulfoanilino, p-sulfoanilino, o-toluidino, m-toluidino, p-toluidino, o-caraboxyanilino, m-caraboxyanilino, p-carboxyanilino, o-chloroaniline, m-chloroaniline, p-chloroanilino, p-aminoanilino, o-anisidino, m-anisidino, p-anisidino, o-acetaminoanilino, hydroxyanilino, disulfophenylamino, naphtylamino, sulfonaphtylamino); a heterocyclylamino group (e.g., 2-benzothiazolylamino, 2-pyridylamino); a substituted or unsubstituted aralkylamino group (e.g., benzylamino, o-anisylamino, m-anisylamino, p-anisylamino); an aryl group (e.g., phenyl); or a mercapto group. $R_1$, $R_2$, $R_3$ and $R_4$ may be the same or different. If —A— is represented by —$A_2$—, at least one of $R_1$, $R_2$, $R_3$ and $R_4$ needs to contain one or more sulfo groups in the form of a free acid group or a salt.

$B_1$, $R_2$, $B_3$ and $B_4$ each independently represents —CH= or —N=, provided that one of $B_1$ and $B_2$ represents —CH= and the other represents —N= and that one of $B_3$ and $B_4$ represents —CH= and the other represents —N=.

(II)

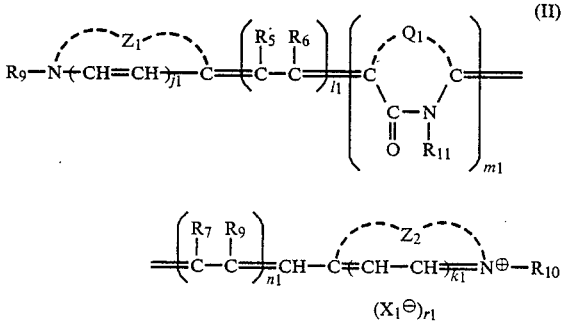

In general formula (II), $Z_1$ and $Z_2$, which may be the same or different, each represents a 5- or 6-membered nitrogen-containing heterocycle-forming atomic group. Examples of 5-or 6-membered nitrogen-containing heterocycle-forming atomic groups include thiazoline, thiazole, benzothiazole, naphthothiazole, selenazoline, selenazole, benzoselenazole, naphthoselenazole, oxazole, benzoxazole, naphthoxazole, bensimidazole, naphtoimidazole, pyridine, quinoline, indolenine, imidazo-[4,5-b]quinozaline, and benzotellurazole. These heterocyclic nuclei may be substituted. Examples of substituents to be contained in these heterocyclic nuclei include a lower alkyl group which preferably contains 6 or less carbon atoms and which may be further substituted by a substituent (e.g., hydroxyl, halogen, phenyl, substituted phenyl, carboxyl, alkoxycarbonyl, alkoxyl); a lower alkoxyl group which preferably contains 6 or less carbon atoms; and acylamino group which preferably contains 8 or less carbon atoms; a monocyclic aryl group; a carboxyl group; a lower alkoxycarbonyl group which preferably contains 6 or less carbon atoms; a hydroxyl group; a cyano group; and a halogen atom.

If the heterocycle represented by $Z_1$ or $Z_2$ is a heterocycle containing another substitutable nitrogen atoms such as benzimidazole, naphthoimidazole, or imidazo-[4,5-b], the substitutable nitrogen atom may be substituted by an alkyl or alkenyl group containing 6 or less carbon atoms which may be further substituted by a hydroxyl group, an alkoxyl group, a halogen atom, a phenyl group or an alkoxycarbonyl group.

$Q_1$ represents a 5- or 6-membered nitrogen-containing ketomethylene ring-forming atomic group. Examples of 5- or 6-membered nitrogen-containing ketomethylene ring-forming atomic groups include thiazolidine-4-one, selenazolidine-4-one, oxazolidine-4-one and imidazolidine-4-one.

$R_5$, $R_6$, $R_7$ and $R_8$ each independently represents a hydrogen atom, a lower alkyl group which preferably contains 4 or less carbon atoms, or a phenyl or aralkyl group which may be substituted.

$R_9$ and $R_{10}$ each independently represents an alkyl or alkenyl group having 10 or less carbon atoms which may contain one or more oxygen atoms, sulfur atoms and/or nitrogen atoms in the carbon chain and may be substituted. Examples of substituents include a sulfo group, a carboxyl group, a hydroxyl group, a halogen atom, an alkoxycarbonyl group, a carbamoyl group, a phenyl group, a substituted phenyl group and a tetrahydrofuryl group. $R_{11}$ has the same meaning as $R_9$ or represents a substitutable aryl group, preferably a monocyclic aryl group (e.g., phenyl, tolyl, hydroxyphenyl, sulfophenyl, carboxyphenyl), or a substitutable 5- or 6-membered heterocyclic group, preferably a monocyclic heterocyclic group (e.g., 2-pyridyl, 3-methyl-2-pyridyl, 3-pyridyl, furyl, thienyl, tetrahydrofuryl).

It is preferred that at least one of $R_9$, $R_{10}$ and $R_{11}$ contains a sulfo group or a carboxyl group.

$l_1$ and $n_1$ each independently represents an integer of 0 to 3, with the proviso, that $(l_1+n_1)$ represents 1, 2 or 3. When $l_1$ is 1, 2 or 3, $R_9$ and $R_5$ may be connected to each other to form a 5- or 6-membered ring. When $l_1$ represents 2 or 3 and $n_1$ represents 2 or 3, two $R_5$'s, two $R_6$'s, two $R_7$'s or two $R_8$'s may be connected to each other to form a 5- or 6-membered ring which may contain one or more oxygen atoms, sulfur atoms and/or nitrogen atoms. $j_1$, $k_1$ and $m_1$ each independently represents an integer of 0 or 1.

$X_1^{\ominus}$ represents an acid anion. $r_1$ represents an integer of 0 or 1.

The compound represented by general formula (II) is preferably one represented by one of general formulae (II-A) to (II-C):

(II-A)

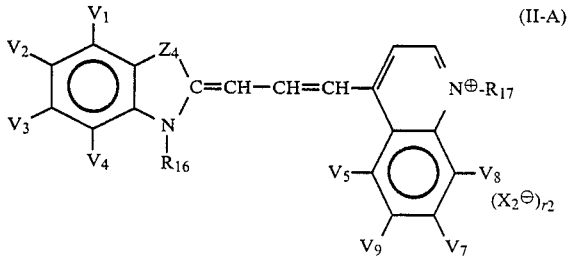

In general formula (II-A), $Z_4$ represents an oxygen atom, a sulfur atom, a selenium atom, —CH=CH— or >N—$R_{18}$ in which $R_{18}$ represents an alkyl or alkenyl group containing 6 or less carbon atoms which may be substituted by a hydroxyl group, a substitutable phenyl group, an alkoxyl group, a halogen atom, or an alkoxycarbonyl group. Examples of such an alkyl or alkenyl group include a methyl group, an ethyl group, a propyl group, a methoxyethyl group, an ethoxycarbonylmethyl group, a 2-fluoroethyl group, a phenethyl group, a 2-hydroxyethyl group, and an allyl group.

$V_1$ and $V_4$ each represent a hydrogen atom.

If $Z_4$ represents an oxygen atom, a sulfur atom, a selenium atom, or —CH=CH—, $V_2$ and $V_3$ each independently represents a hydrogen atom, a fluorine atom, a chlorine atom, a trifluoromethyl group, an alkylacyl group containing 5 or less carbon atoms, an alkoxycarbonyl group containing 5 or less carbon atoms, an acylamino group containing 5 or less carbon atoms, an alkyl group containing 5 or less carbon atoms, an alkoxyl group containing 5 or less carbon atoms, a phenylacyl group containing 5 or less carbon atoms which may be substituted, or a phenyl group. $V_1$ and $V_2$, $V_2$ and $R_3$ or $V_3$ and $V_4$ may be connected to each other to form benzo ring or a 5- or 6-membered saturated ring which may contain one or more oxygen atoms, nitrogen atoms, and/or sulfur atoms (e.g., dioxymethylene, propylene). When $Z_4$ represents $>N—R_{18}$, $V_2$ and $V_3$, which may be the same or different, each represents an electron attractive substituent. Particularly preferred examples of such electron attractive substituents include a chlorine atom, a trifluoromethyl group, a cyano group, an alkylacyl group containing 5 or less carbon atoms, and an alkylsulfonyl group containing 5 or less carbon atoms. $V_5$, $V_6$, $V_7$ and $V_8$ each independently represents a hydrogen atom, a fluorine atom, a chlorine atom, a trifluoromethyl group, an alkyl group containing 5 or less carbon atoms, an alkoxyl group containing 5 or less carbon atoms, or an alkoxycarbonyl group containing 5 or less carbon atoms.

Preferred examples of heterocyclic groups containing $Z_4$ include benzothiazole, 5-methylbenzothiazole, 5-ethylbenzothiazole, 5-methoxybenzothiazole, 6-methoxybenzothiazole, 5-chlorobenzothiazole, 5-chloro-6-methylbenzothiazole, 5,6-dimethylbenzothiazole, 5-phenylbenzothiazole, 5-acetylaminobenzothiazole, 6-propionylaminobenzothiazole, 5,6-dimethoxybenzothiazole, 5,6-dioxymethylenebenzothiazole, 5,6,7,8-tetrahydronaphtho[2,3-d]thiazole, benzoxazole, 5-methylbenzoxazole, 5-isopropylbenzoxazole, 5-methoxybenzoxazole, 5-ethoxybenzoxazole, 5-chlorobenzoxazole, 5-chloro-6-methylbenzoxazole, 5-phenylbenzoxazole, 5-p-tolylbenzoxazole, benzoselenazole, 5-methylbenzoselenazole, 5-methoxybenzoselenazole, 6-methoxybenzoselenazole, 6-methylbenzoselenazole, 5-ethylbenzoselenazole, 5-phenylbenzoselenazole, 5-chlorobenzoselenazole, 5-chlorobenzoimidazole, 5,6-dichlorobenzimidazole, 5-cyanobenzimidazole, 6-chloro-5-cyanobenzimidazole, 6-chloro-5-trifluorobenzimidazole, 5-butoxycarbonylbenzimidazole, 5-ethoxycarbonylbenzimidazole, 5-methylsulfonylbenzimidazole, 6-chloro-5-ethoxycarabonylbenzimidazole, naphtho[1,2-d]thiazole, naphtho[2,1-d]thiazole, naphtho[1,2-d]selenazole, naphtho[1,2-d]oxazole, naphtho[2,3-d]-oxazole, naphtho[2,1-d]oxazole, 2-quinoline, 6-methyl-2-quinoline, 6-hydroxy-2-quinoline, and 6-methoxy-2-quinoline.

$R_{16}$ and $R_{17}$ each independently represents an alkyl or alkenyl group containing 6 or less carbon atoms which may be substituted. Examples of substituents which may be contained in these alkyl or alkenyl groups include an alkoxyl group, a halogen atom, a carbamoyl group, a carboxyl group, an alkoxycarbonyl group, a sulfo group, a phenyl group which may be substituted, and a hydroxyl group. Specific examples of such alkyl or alkenyl groups include a methyl group, an ethyl group, a propyl group, a pentyl group, an allyl group, a methoxymethyl group, an ethoxyethyl group, a 2,2,2-trifluoroethyl group, a 2,2,3,3-tetrafluoropropyl group, a carbamoylethyl group, a hydroxyethyl group, a carboxymethyl group, a carboxyethyl group, a 2-sulfoethyl group, a 3-sulfoethyl group, a 3-sulfobutyl group, a 4-sulfobutyl group, a phenethyl group, a p-sulfophenethyl group, an ethoxycarbonylethyl group, and a 2-hydroxy-3-sulfopropyl group.

At least one of $R_{16}$ and $R_{17}$ is preferably a sulfoalkyl group.

$X_2^{\ominus}$ represents an acid anion. $r_2$ represents 0 or 1.

(II-B)

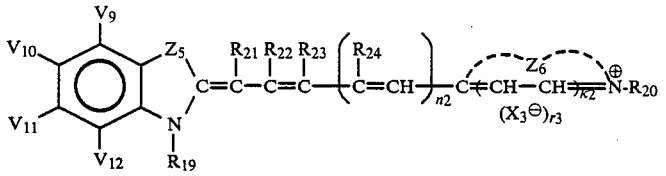

In general formula (II-B), $Z_5$ represents an oxygen atom, a sulfur atom, a selenium atom, $>N—R_{25}$ or —CH=CH—. $R_{25}$ has the same meaning as $R_{15}$.

$Z_6$ represents an atomic group which, together with the adjacent atoms, forms a benzothiazole, benzoselenazole, benzoxazole, benzimidazole, quinoline, naphthothiazole, naphthoselenazole, naphthoxazole or naphthoimidazole group. These heterocyclic groups may contain substituents. As such substituents, there may be used those described with reference to $V_2$ or $V_3$.

$V_9$, $V_{10}$, $V_{11}$ and $V_{12}$ have the same meaning as $V_1$, $V_2$, $V_3$ and $V_4$, respectively.

When $Z_5$ represents $>N—R_{25}$, $V_{10}$ preferably represents a hydrogen atom or a chlorine atom and $V_{11}$ preferably represents a chlorine atom, a perfluoroalkyl group containing 4 or less carbon atoms (e.g., trifluoromethyl, 1,1,2,2-tetrafluoroethyl), a cyano group, an alkoxycarbonyl group containing 5 or less carbon atoms, or an alkylacyl group containing 5 or less carbon atoms (e.g., acetyl, propionyl, methanesulfonyl). When $Z_6$ represents an atomic group required for the formation of benzimidazole, the substituent which may be contained in the benzimidazole nucleus is preferably an electron attractive group. Particularly preferred examples of such an electron attractive substituent include those described as preferred examples of $V_{11}$.

Preferred examples of heterocyclic groups containing $Z_5$ or $Z_6$ include heterocyclic groups as described with reference to the compound of general formula (II-A).

$R_{19}$ and $R_{20}$ each independently has the same meaning as $R_{16}$, or each has the same meaning as $R_{17}$. Alternatively, $R_{19}$ may be connected to $R_{21}$ to form a 5- or 6-membered ring. Particularly preferably, at least one of $R_{19}$ and $R_{20}$ represents a sulfoalkyl group.

$R_{21}$ represents a hydrogen atom. $R_{22}$ and $R_{24}$ each independently represents a hydrogen atom, an alkyl group containing 4 or less carbon atoms, or an alkoxyl group containing 4 or less carbon atoms. $R_{22}$ and $R_{24}$, which may be are the same or different, may also be connected to each other to form, together with the adjacent atoms, a 5- or 6-membered ring which may contain one or more oxygen atoms, sulfur atoms and/or nitrogen atoms.

$R_{23}$ represents a hydrogen atom, an alkyl group containing 5 or less carbon atoms, or a benzyl group containing 9 or less carbon atoms, either or both of which may be substituted.

$n_2$ represents 1 or 2. $X_3^{\ominus}$ represents an acid anion. $k_2$ and $r_3$ each represents 0 to 1.

The compound represented by general formula (II-B) may be preferably used in the present invention as compared to the compound represented by general formula (II-A).

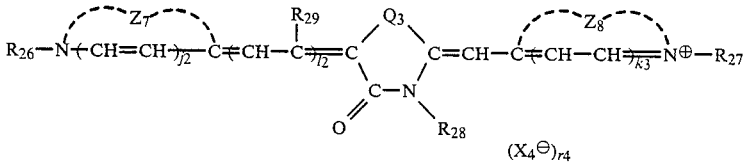

(II-C)

In general formula (II-C), $Z_7$ and $Z_8$ each independently represents an atomic group which, together with the adjacent atoms, forms a thiazole, benzothiazole, naphthothiazole, selenazole, benzoselenazole, naphthoselenazole, benzoxazole, naphthoxazole pyridine, or quinoline group. These heterocyclic groups may be substituted. As substituents, there may be used those described as examples of groups represented by $V_2$. Specific examples of particularly preferred heterocyclic groups include heterocyclic rings described as examples of the compound of general formula (II-A).

$Q_3$ represents an oxygen atom, a sulfur atom, a selenium atom or $>N—R_{30}$. $R_{26}$ and $R_{27}$ each has the same meaning as $R_{16}$, or each has the same meaning as $R_{17}$.

$R_{29}$ represents a hydrogen atom, an alkyl group containing 4 or less carbon atoms, or a phenyl group which may be substituted.

$R_{28}$ and $R_{30}$ each independently has the same meaning as $R_{16}$ or represents a monocyclic aryl group which may be substituted (e.g., phenyl, tolyl, chlorophenyl, hydroxyphenyl, 4-sulfophenyl, 4-caraboxyphenyl), a monocyclic heterocyclic group which may be substituted (e.g., 2-pyridyl, 3-pyridyl, 4-methyl-2-pyridyl, furyl), or a monocylic 5- or 6-membered heterocyclic group-substituted alkyl group (e.g., furfuryl).

$X_4^{\ominus}$ represents an acid anion. $j_2$, $k_3$ and $r_4$ each independently represents 0 or 1. $l_2$ represents 1 or 2.

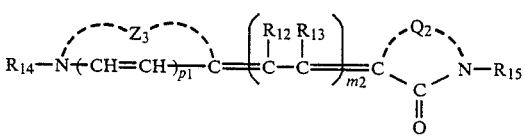

(III)

In general formula (III), $Z_3$ represents a 5- or 6-membered nitrogen-containing heterocyclic group-forming atomic group. Examples of such an atomic group include a heterocyclic nucleus used to form cyanines such as thiazoline, thiazole, benzothiazole, naphthothiazole, selenazole, benzoselenazole, naphthoselenazole, oxazole, benzoxazole, naphthoxazole, benzimidazole, naphthoimidazole, pyridine, quinoline, pyrrolidine, indolenine, imidazo[4,5-b]-quinozaline, and benzoterrazole. These heterocyclic nuclei may be substituted. Examples of substituents which may be contained in these heterocyclic nuclei include a lower alkyl group which preferably contains 10 or less carbon atoms (which may be further substituted by a hydroxyl group, a halogen atom, a phenyl group, a substituted phenyl group, a carboxyl group, an alkoxycarbonyl group, an alkoxyl group, etc.); a lower alkoxyl group which preferably contain 7 or less carbon atoms; an acylamino group which preferably contains 8 or less carbon atoms; a monocyclic aryl group; a monocyclic aryloxyl group; a carboxyl group; a lower alkoxycarbonyl group which preferably contains 7 or less carbon atoms; a hydroxyl group; a cyano group; and a halogen atom.

$Q_2$ represents a 5- or 6-membered nitrogen-containing ketomethylene ring-forming atomic group. Examples of such an atomic group include groups which form a heterocyclic nucleus which in turn can form merocyanine dyes such as rhodanine, 2-thiohydantoin, 2-selenathiohydantoin, 2-thiooxazolidine-2,4-dione, 2-selenaoxazolidine-2,4-dione, 2-thioselenazolidine-2,4-dione, 2-selenathiazolidine-2,4-dione, and 2-selena-selenazoline-2,4-dione.

In the heterocyclic rings represented by $Z_3$ and $Q_2$, if two or more nitrogen atoms are contained in the heterocyclic ring-forming atomic group as in benzimidazole or thioydantoin, the nitrogen atom to which $R_{14}$ or $R_{15}$ is not bonded may be substituted. Particularly, carbon atoms in the alkyl chain may be substituted by an oxygen atom, a sulfur atom or a nitrogen atom. Further examples of such substituents include an alkyl or alkenyl group containing 8 or less carbon atoms which may be further substituted and a monocyclic aryl group or monocyclic heterocyclic group which may be further substituted.

$R_{12}$ represents a hydrogen atom or an alkyl group containing 4 or less carbon atoms. $R_{13}$ represents a hydrogen atom, a phenyl group which may be substituted by an alkyl or alkoxyl group containing 4 or less carbon atoms, a halogen atom, a carboxyl group, a hydroxyl group, or the like, or an alkyl group which may be substituted by a hydroxyl group, a carboxyl group, an alkoxyl group, a halogen atom, or the like.

$R_{14}$ represents an alkyl or alkenyl group containing 10 or less carbon atoms which may contain oxygen atoms, sulfur atoms or nitrogen atoms in carbon chains and may be substituted. Examples of substituents which may be contained in such an alkyl or alkenyl group include a sulfo group, a carboxyl group, a hydroxyl group, a halogen atom, an alkoxycarbonyl group, a carbamoyl group, a phenyl group, a substituted phenyl group, and a monocyclic saturated heterocyclic group.

$R_{15}$ has the same meaning as $R_{14}$ or represents a hydrogen atom, a monocyclic aryl group which may be substituted by a sulfo group, a carboxyl group, a hydroxyl group, a halogen atom, or an alkyl, acylamino or alkoxyl group containing 5 or less carbon atoms, or a 5- or 6-membered monocyclic heterocyclic group (e.g., 2-pyridyl, 3-pyridyl, 4-methyl-2-pyridyl, furyl).

$m_2$ represents 2 or 3, further provided that two $R_{13}$'s may be connected to each other to form a 5- or 6-membered ring which may contain one or more oxygen atoms, sulfur atoms, and/or nitrogen atoms. $p_1$ represents 0 or 1.

$R_{12}$ and $R_{14}$ may be connected to each other to form a 5- or 6-membered ring.

Preferably, at least one of $R_{14}$ and $R_{15}$ is a group containing a sulfo group or a carboxyl group.

The compound represented by general formula (III) is preferably a compound represented by general formula (III-A):

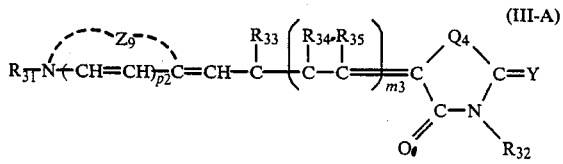

(III-A)

In general formula (III-A), $Z_9$ represents a 5- or 6-membered heterocycle-forming atomic group. Preferred examples of such an atomic group include groups which, together with the adjacent atoms, form a thiazoline, thiazole, benzothiazole, naphthothiazole, selenazoline, selenazole, benzoselenazole, naphthoselenazole, oxazole, benzoxazole, naphthoxazole, benzimidazole, naphthoimidazole, pyridine, quinoline, or benzotellurazole group. Such a 5- or 6-membered heterocyclic group may be substituted. Examples of such a 5- or 6-membered heterocyclic group include those described with reference to general formula (III). Particularly preferred examples of substituents which may be contained in such a heterocyclic group as benzimidazole include a chlorine atom, a cyano group, an alkoxycarbonyl group containing 5 or less carbon atoms, a perfluoroalkyl group containing 4 or less carbon atoms, and an acyl group containing 5 or less carbon atoms (e.g., acetyl, methanesulfonyl). Examples of substituents which may be contained in a heterocyclic nucleus other than benzimidazole include an alkyl group containing 5 or less carbon atoms which may be substituted by a hydroxyl group, a carboxyl group, a halogen atom, a phenyl group, an alkoxycarbonyl group, or the like, a phenyl group containing 8 or less carbon atoms, which may be substituted by a hydroxyl group, a halogen atom, an alkoxy group, an acylamino group, an alkylaminocarbonyl group, a carboxyl group, or the like, a phenyl group, a furyl group, a thienyl group, a pyridyl group, an alkoxy group containing 5 or less carbon atoms, an alkoxycarbonyl group containing 5 or less carbon atoms, a hydroxyl group, a halogen atom, and a carboxyl group.

$Q_4$ represents an oxygen atom, a sulfur atom, a selenium atom or $>N—R_{36}$, in which $R_{36}$ may contain one or more oxygen atoms, sulfur atoms and/or nitrogen atoms is the carbon chain and represents an alkyl group containing 8 or less carbon atoms which may be substituted by a hydroxyl group, a halogen atom, an alkylaminocarbonyl group, an alkoxycarbonyl group, a carbonyl group, a substituted phenyl group, or the like, or a monocyclic aryl group or a monocyclic heterocyclic group which may be substituted. Particularly preferred examples of such a substituent include an alkyl group containing 6 or less carbon atoms which may be substituted by a hydroxyl group, an alkylaminocarbonyl group, an alkoxycarbonyl group, or a carboxyl group and may contain one or more oxygen atoms in the carbon chain and a phenyl or pyridyl group which may be substituted by a hydroxyl group, an alkyl group, a chlorine atom, an alkoxyl group, or the like.

Y represents a sulfur atom or a selenium atom.

$R_{31}$ represents an alkyl or alkenyl group containing 8 or less carbon atoms which may contain one or more oxygen atoms and/or sulfur atoms in the carbon chain and may be substituted. Examples of substituents which may be contained in such an alkyl or alkenyl group include a sulfo group, a carboxyl group, a hydroxyl group, a halogen atom, an alkoxycarbonyl group, a carbamoyl group, a phenyl group which may be further substituted, and a monocyclic saturated heterocyclic group.

$R_{32}$ has the same meaning as $R_{31}$, or represents a hydrogen atom, a monocyclic aryl group containing 8 or less carbon atoms which may be substituted, or a 5- or 6-membered substituted or unsubstituted monocyclic heterocyclic group. Examples of substituents which may be contained in such a monocyclic aryl group or a 5- or 6-membered monocyclic heterocyclic group include an alkyl group, an alkoxyl group, a chlorine atom, a carboxyl group, a sulfo group, and an acylamino group. Preferred examples of such an aryl group include a phenyl group. Preferred examples of a 5- or 6-membered monocyclic heterocyclic group include a pyridyl group, a furyl group, and a thienyl group.

$R_{33}$ represents a hydrogen atom, a phenyl group containing 8 or less carbon atoms which may be substituted by an alkyl group, an alkoxyl group, a chlorine atom, a carboxyl group, a hydroxyl group, or the like, or an alkyl group containing 6 or less carbon atoms which may be further substituted by a hydroxyl group, a carboxyl group, an alkoxyl group, a fluorine atom, or a chlorine atom.

$R_{35}$ represents a hydrogen atom. $R_{33}$ and $R_{35}$, or two $R_{35}$'s may be connected to each other to form a 5- or 6-membered heterocyclic ring which may contain one or more oxygen atoms and/or nitrogen atoms.

$R_{34}$ represents a hydrogen atom or an alkyl group containing 4 or less carbon atoms.

$p_2$ represents 0 or 1. $m_3$ represents 1 or 2.

Specific examples of compounds which can be used in the present invention will be described hereinafter, but the present invention should not be construed as being limited thereto.

Specific examples of ascorbic acid compounds which can be used in the present invention include the following:

(A-1) L-Ascorbic acid
(A-2) Sodium L-ascorbate
(A-3) Potassium L-ascorbate
(A-4) DL-Ascorbic acid
(A-5) Sodium D-ascorbate
(A-6) L-Ascorbate-6-acetate
(A-7) L-Ascorbate-6-palmitate
(A-8) L-Ascorbate-6-benzoate
(A-9) L-Ascorbate-6-diacetate
(A-10) L-Ascorbate-5,6-O-isopropyridene Specific examples of the compound represented by general formula (I) include those as follows:

(I-1) 4,4'-Bis[4,6-di(benzothiazolyl-2-thio)pyrimidine-2-yl-amino]stilbene-2,2-disodium disulfonate
(I-2) 4,4'-Bis[4,6-di(benzothiazolyl-2-amino)-pyrimidine-2-yl-amino)]stilbene-2,2'-disodium disulfonate
(I-3) 4,4'-Bis[4,6-di(naphthyl-2-oxy)pyrimidine-2-yl-amino]stilbene-2,2'-disodium disulfonate
(I-4) 4,4'-Bis[4,6-di(naphthyl-2-oxy)pyrimidine-2-yl-amino]bibenzyl-2,2'-disodium disulfonate
(I-5) 4,4'-Bis(4,6-dianilinopyrimidine-2-yl-amino)-stilbene-2,2'-disodium disulfonate
(I-6) 4,4'-Bis[4-chloro-6-(2-naphthyloxy)pyrimidine-2-yl-amino]biphenyl-2,2'-disodium disulfonate
(I-7) 4,4'-Bis[4,6-di(1-phenyltetrazolyl-5-thio)pyrimidine-2-yl-amino]stilbene-2,2'-disodium disulfonate
(I-8) 4,4'-Bis[4,6-di(benzoimidazolyl-2-thio)pyrimidine-2-yl-amino]stilbene-2,2'-disodium disulfonate
(I-9) 4,4'-Bis(4,6-diphenoxypyrimidine-2-yl-amino)stilbene-2,2'-disodium disulfonate (I-10) 4,4'-Bis(4,6-diphenyltiopyrimidine-2-yl-amino)-stilbene-2,2'-disodium disulfonate (I-11) 4,4'-Bis(4,6-dimercaptopyrimidine-2-yl-amino)-biphenyl-2,2'-disodium disulfonate (I-12) 4,4'-Bis[2,6-di(naphthyl-2-oxy)pyrimidine-4-yl-amino]stilbene-2,2'-disodium disulfonate (I-13) 4,4'-Bis[2,6-di(naphthyl-2-oxy)pyrimidine-4-yl-amino]bibenzyl-2,2'-disodium disulfonate (I-14) 4,4'-Bis[2,6-diphenylthiopyrimidine-4-yl-amino]-stilbene-2,2'-disodium disulfonate (I-15) 4,4'-Bis[2,6-diphenoxypyrimidine-4-yl-amino]stilbene-2,2'-disodium disulfonate (I-16) 4,4'-Bis[2,6-di(benzothiazolyl-2-thio)pyrimidine-4-yl-amino]stilbene-2,2'-disodium disulfonate Particularly preferred among these specific examples are (I-3), (I-12), (I-13), (I-14), (I-15) and (I-16).

Specific examples of the sensitizing dyes represented by general formula (II) are shown below.

(II-1)

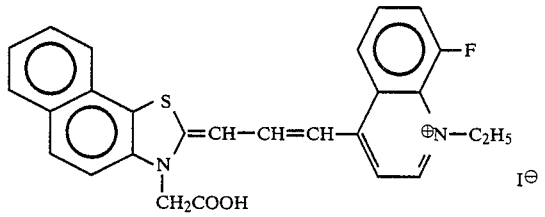

(II-2)

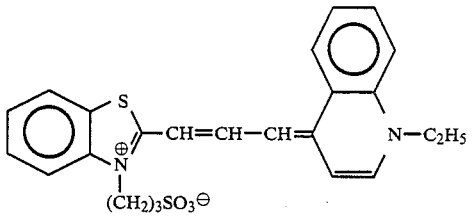

(II-3)

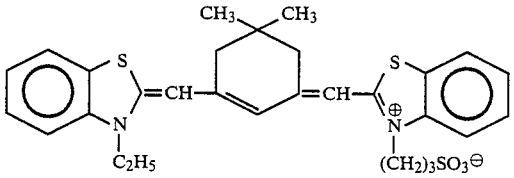

(II-4)

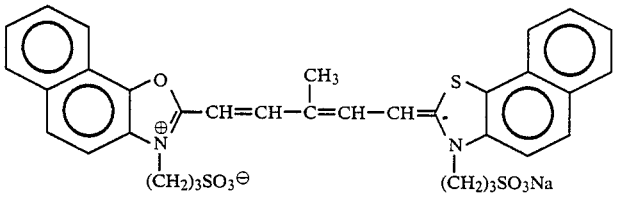

(II-5)

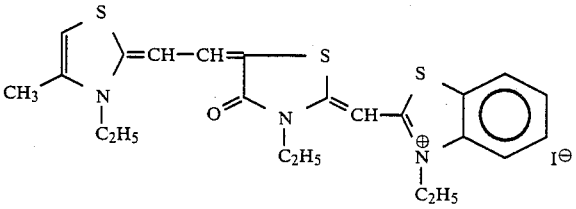

(II-6)

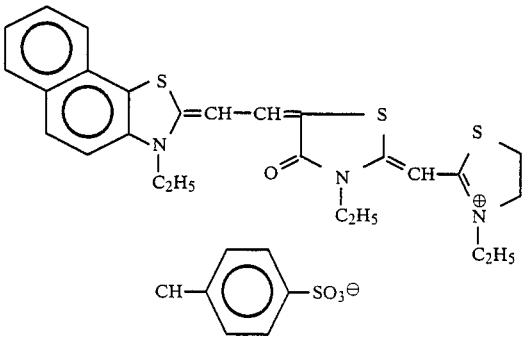

-continued
(II-7)
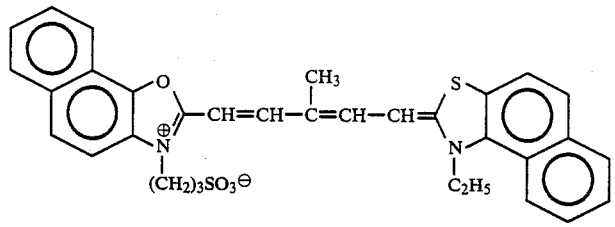
(II-8)
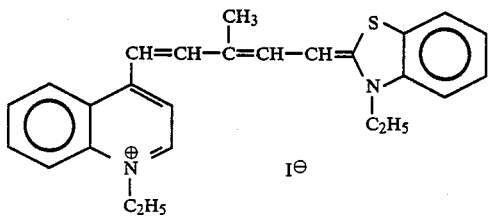
(II-9)
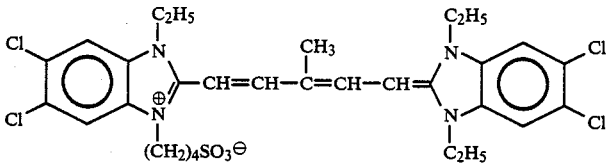
(II-10)
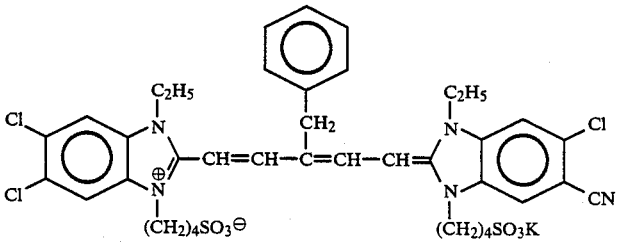
(II-11)
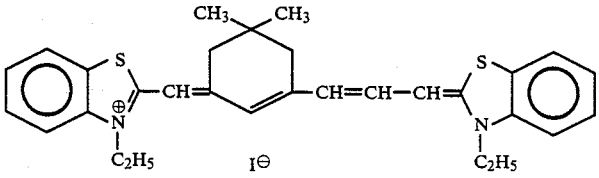
(II-12)
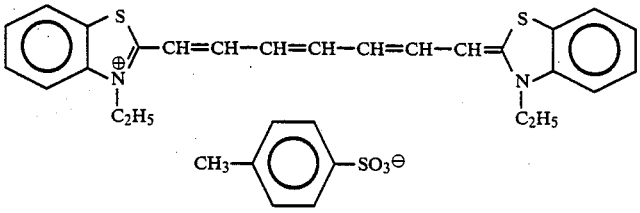
(II-13)
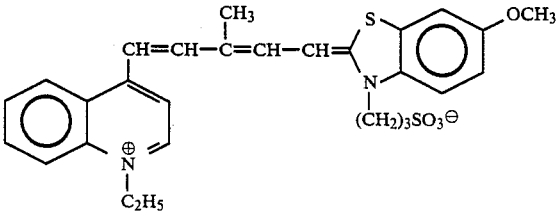

-continued
(II-14)
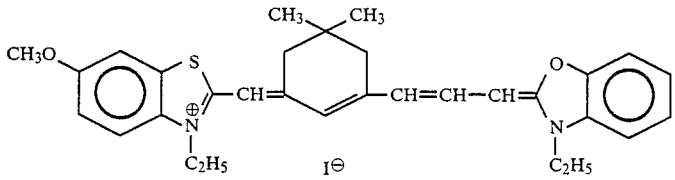
(II-15)
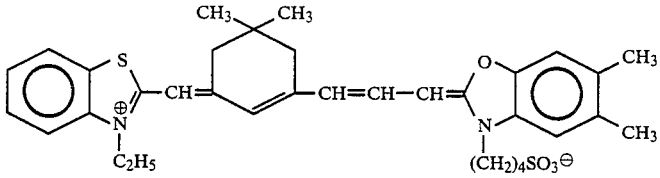
(II-16)
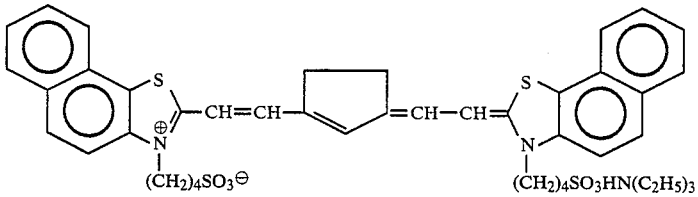
(II-17)
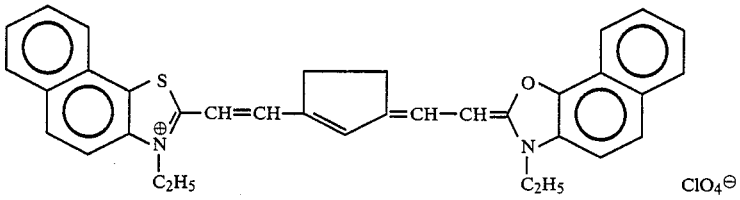
(II-18)
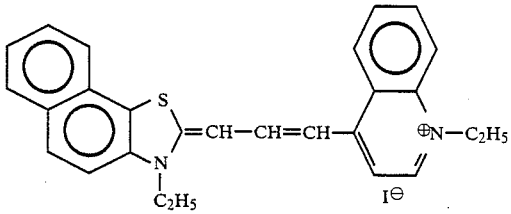
(II-19)
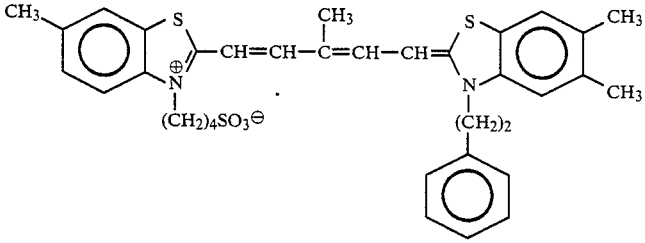
(II-20)
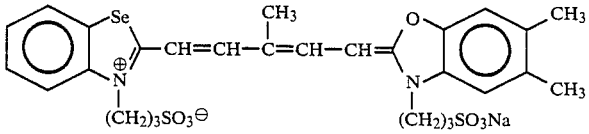
(II-21)
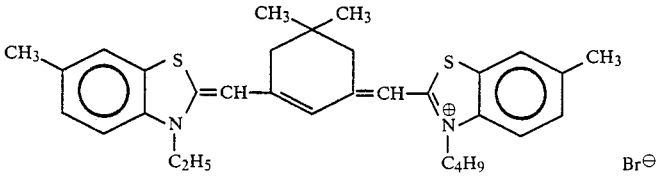

-continued
(II-22)
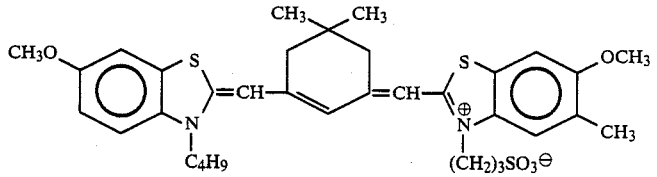
(II-23)
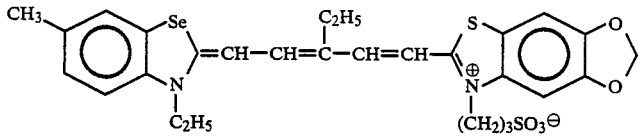
Specific examples of the sensitizing dyes represented by general formula (III) are shown below.
(III-1)
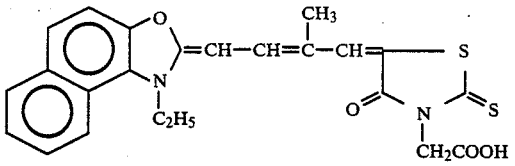
(III-2)
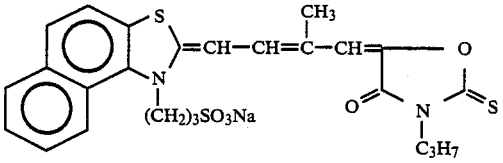
(III-3)
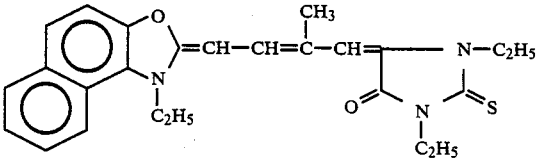
(III-4)
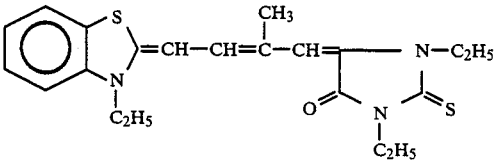
(III-5)
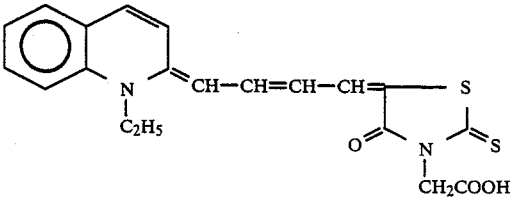
(III-6)
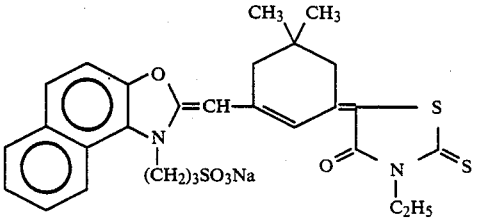

-continued
(III-7)
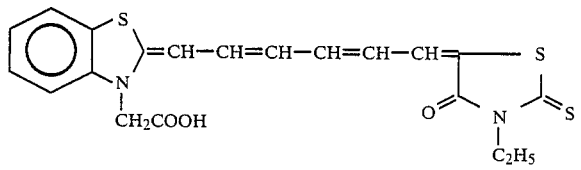
(III-8)
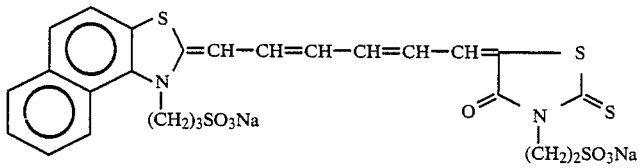
(III-9)
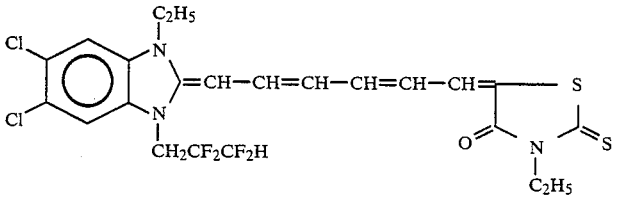
(III-10)
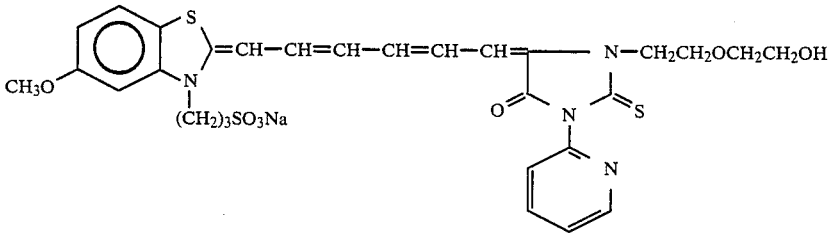
(III-11)
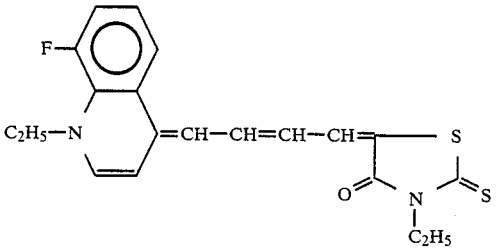
(III-12)
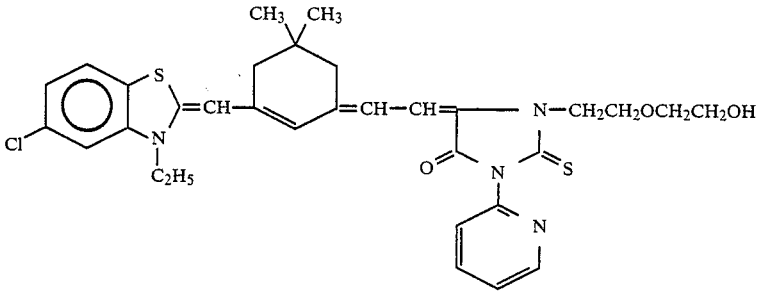
(III-13)
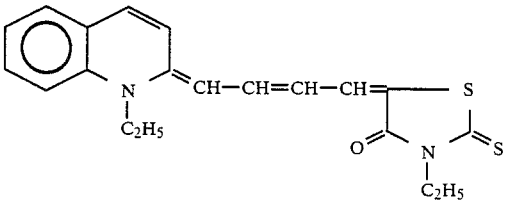

-continued

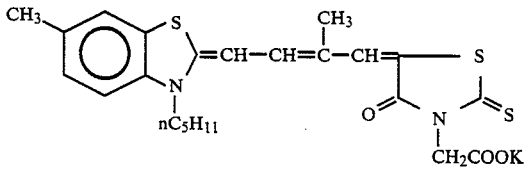

(III-14)

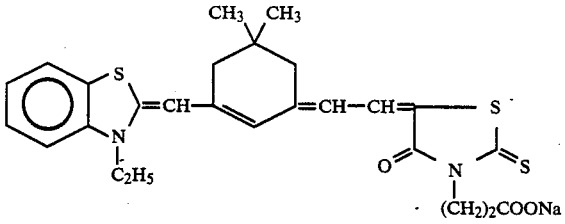

(III-15)

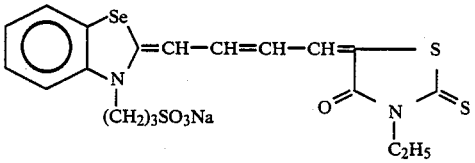

(III-16)

The above-described ascorbic acid compound can be incorporated in the present silver halide emulsion by directly being dispersed in the emulsion or by being added to the emulsion in the form of a solution in a single or mixed solvent of water, methanol, ethanol, and the like. The ascorbic acid compound may be present in any of the steps of the production of the photographic emulsion regardless of whether it is before or after the addition of the sensitizing dye.

The ascorbic acid compound to be used in the present invention is incorporated in the silver halide photographic emulsion generally in a proportion of from $1\times10^{-6}$ mol to $5\times10^{-2}$ mol, preferably from $1\times10^{-5}$ mol to $2\times10^{-2}$ mol, and more preferably from $1\times10^{-4}$ mol to $1.6\times10^{-2}$ mol, per mol of silver halide.

The compounds represented by general formula (I) are known compounds and are disclosed in JP-B-45-32741. Similar compounds which are not described in this patent publication can be easily prepared by those skilled in the art in accordance with the method described in this patent publication.

A compound represented by general formula (I) may be directly dispersed in the emulsion or may be added to the emulsion in the form of a solution in a proper solvent such as methyl alcohol, ethyl alcohol, methyl cellosolve, water, or a mixture thereof. Alternatively, the compound may be added to the emulsion in the form of a dispersion in a solvent or colloid in accordance with the method of addition of sensitizing dye. Furthermore, the present compound may be dispersed in the emulsion in accordance with the method described in JP-A-50-80119.

The molar proportion of the sensitizing dye represented by general formula (II) or (III) to the compound represented by general formula (I) is generally in the range of 1/1 to 1/300, preferably ½ to 1/100.

The sensitizing dyes represented by general formulae (II) and (III) are known and are described in JP-A-51-126140, JP-A-51-139323, JP-A-51-14313, JP-A-55-35386, JP-A-52-10925, JP-A-53-135322 and JP-A-47-28916; JP-B-52-2614; West German Patent Disclosure (OLS) No. 2,158,553; F. M. Hamer, *The Chemistry of Heterocyclic Compounds*, Vol. 18, The Cyanine Dyes and Related Compounds, A. Weissberger ed., Interscience, New York, 1964, and D. M. Sturmer, *The Chemistry of Heterocyclic Compounds*, Vol. 30, A. Weissberger and E. C. Taylor ed., John Wiley, New York, 1977, p. 441. These compounds can be synthesized by the method described in these references.

The compound represented by general formula (II) or (III) can be incorporated in the present silver halide emulsion by directly being dispersed in the emulsion or by being added to the emulsion in the form of a solution in a single or mixed solvent such as water, methanol, ethanol, propanol, methyl cellosolve, or 2,2,3,3-tetrafluoropropanol. Alternatively, the compound represented by general formula (II) or (III) may be added to the emulsion in the form of an aqueous solution comprising an acid or base present therewith as described in JP-B-44-23389, JP-B-44-27555 and JP-B-57,22089 or an aqueous solution or colloid dispersion comprising a surface active agent present therewith as described in U.S. Pat. Nos. 2,822,135 and 4,006,025. Furthermore, the compound represented by general formula (II) or (III) may be dissolved in a solvent which is substantially immiscible with water such as phenoxyethanol, dispersed in water or a hydropilic colloid, and then added to the emulsion. Alternatively, the compound represented by general formula (II) or (III) may be directly dispersed in a hydrophilic colloid, and then added to the emulsion as described in JP-A-53-102733 and JP-A-58-105141.

The sensitizing dye to be used in the present invention may be dissolved by an ultrasonic vibration process as described in U.S. Pat. No. 3,485,634. The dissolution or dispersion of the sensitizing dye in the emulsion can be also accomplished by methods as described in U.S. Pat. Nos. 3,482,981, 3,585,195, 3,469,987, 3,425,835, 3,342,605, 3,660,101 and 3,658,546, and British Pat. Nos. 1,271,329, 1,038,029 and 1,121,174.

The sensitizing dye may be present during any of the steps in the process of preparation of the photographic emulsion or during any steps which precede the coating but after the preparation of the emulsion. In the former case, the sensitizing dye may be present at the step of formation, physical ripening or chemical ripening of particulate silver halide. For example, the sensitizing dye may be present during the formation of particulate silver halide as described in JP-A-55-26589.

The sensitizing dye represented by general formula (II) or (III) is incorporated in the silver halide photographic emulsion in a proportion of from $5\times10^{-7}$ to $5\times10^{-3}$ mol, preferably from $5\times10^{-6}$ to $2\times10^{-3}$ mol, and more preferably from $1\times10^{-5}$ to $1\times10^{-3}$ mol, per mol of silver halide.

The present photographic emulsion may comprise any one of silver bromide, silver bromoiodide, silver bromochloroiodide, silver bromochloride, and silver chloride as the silver halide.

The particulate silver halide may be in any crystalline phase, preferably in cubic form.

The silver halide emulsion may comprise tabular particulate silver halide wherein the particles having a thickness of 0.5 μm or less, preferably 0.3 μm or less, a diameter of preferably 0.6 μm or less, and an average aspect ratio of 5 or more account for 50% or more of all the particles as calculated in terms of projected area. Alternatively, the present silver halide emulsion may be a monodisperse emulsion wherein particles having a size within ±40% of the average particle size account for 95% or more of all the particles by number.

The crystalline phase of the present particulate silver halide may be uniform or different from the inner portion to the outer portion of the particles. The emulsion particles may be those of a surface latent image type in which latent images are formed mainly on the surface portion thereof (e.g., negative type emulsion) or those of an internal latent image type in which latent images are formed mainly in the interior thereof (e.g., internal latent image type emulsion and direct reversal type emulsion which has been previously fogged).

The preparation of the photographic emulsion may be accomplished by any suitable method as described in P. Glafkides, *Chimie et Physique Photographique*, Paul Montel, 1967; G. F. Duffin, *Photographic Emulsion Chemistry*, Focal Press, 1966; V. L. Zelikman et al., *Making and Coating Photographic Emulsion*, Focal Press, 1964, etc.

Particularly, the preparation of the silver halide photographic emulsion can be accomplished by any one of an acidic process, a neutral process, and an ammonia process. The process for the reaction of the soluble silver salt with the soluble halide can be accomplished by a separate mixing process, a simultaneous mixing process, or a combination thereof.

The process for the reaction of the soluble silver salt with the soluble silver halide can be accomplished by a process in which particles are formed in excess silver ions (so-called reversal mixing process).

One form of the simultaneous mixing process is a so-called controlled double jet process in which the pAg of the liquid phase in which silver halide is formed is kept constant. This process can provide a silver halide emulsion having a regular crystal structure and a nearly uniform particle size.

Two or more silver halide emulsions which have been separately prepared may be mixed before use.

In the formation of the particulate silver halide, a silver halide solvent such as ammonia, potassium thiocyanate, ammonium thiocyanate, a thioether compound described in U.S. Pat. Nos. 3,271,157, 3,574,628, 3,704,130, 4,297,439 and 4,276,374, a thione compound described in JP-A-53-144319, JP-A-53-82408 and JP-A-55-77737, an amine compound as described in JP-A-54-100717, or the like may be used to control the growth of the particles.

In the process of the formation or physical ripening of particulate silver halide, a cadmium salt, zinc salt, lead salt, thallium salt, iridium salt, or complex salt thereof, rhodium salt or complex salt thereof, or iron salt or complex salt thereof may be present.

Examples of internal latent image type emulsions which can be used in the present invention include an emulsion comprising diverse metals incorporated therein as described in U.S. Pat. Nos. 2,592,250, 3,206,313, 3,447,927, 3,761,276 and 3,935,014.

The present silver halide emulsion is normally subjected to chemical sensitization. The chemical sensitization may be accomplished by any suitable method as described in H. Frieser, *Die Grundlagen der Photographischen Prozesse mit Silberhalogeniden*, Akademische Verlagsgesellschaft, 1968, pp. 675–734. Preferred methods include a sulfur sensitization process with a sulfur-containing compound capable of reacting with active gelatin or silver such as thiosulfate, thiourea, mercapto compound, and rhodanine; a reduction sensitization process with a reducing substance such as stannous salt, amine, hydrazine, derivative, formamidine sulfinic acid, and silane compound, and a noble metal sensitization process with a noble metal compound such as gold complex or a complex of the group VIII metals such as Pt, Rh, Ir, and Pd which may be used singly or in combination.

Specific examples of chemical sensitizing agents which can be used in such a chemical sensitization process include a sulfur sensitizing agent such as allylthiocarbamide, thiourea, sodium thiosulfate, or crystine; a noble metal sensitizing agent such as potassium chloroaurate, aurous thiosulfate, or potassium chloropalladate; and a reduction sensitizing agent such as stannous chloride, phenyl hydrazine, or reductone. Specific examples of other chemical sensitizing agents include polyoxyethylene compounds, polyoxypropylene compounds, and compounds containing a quaternary ammonium group.

The photographic emulsion may also comprise various compounds for the purpose of inhibiting fog during the preparation, preservation or photographic processing of the light-sensitive material or stabilizing the photographic properties of the light-sensitive material. Examples of such compounds which may be incorporated in the present photographic emulsion include compounds known as fog inhibitors or stabilizers such as azoles (e.g., benzothiazolium salt, nitroindazoles, triazoles, benzotriazoles, benzimidazoles (particularly, nitro- or halogen-substituted benzimidazoles)), heterocyclic mercapto compounds (e.g., mercaptothiazoles, mercaptobenzothiazoles, mercaptobenzimidazoles, mercaptothiadiazoles, mercaptotetrazoles (particularly, 1-phenyl-5-mercaptotetrazole, 1-(3-N'-metylrueidophenyl)-5-mercaptotetrazole and 1-(3-sulfophenyl)-5-mercaptotetrazole), mercaptopyrimidine, heterocyclic mercapto compounds containing a water-soluble group such as a carboxyl group and a sulfone group, thioketo compounds (e.g., oxazolinethione), azaindenes (e.g., tetraazaindenes (particularly 4-hydroxy-substituted (1,3,3*a*7)tetraazaindenes)), benzenethiosulfonic acids, and benzenesulfinic acids.

For the purpose of improving the dimensional stability of the photographic material or the physical properties of the film, the silver halide emulsion may also comprise a polymer latex made of homopolymers or copolymers such as alkyl acrylate, alkyl methacrylate, acrylic acid, and glycidyl acrylate described in U.S. Pat. Nos. 3,411,911, 3,411,912, 3,142,568, 3,325,286 and 3,547,650, and JP-B-45-5331.

When the silver halide emulsion is used as a lith type printing light-sensitive material, a polyalkylene oxide capable of improving the infectious development effect may be used. Examples include those compounds described in U.S. Pat. Nos. 2,400,532, 3,294,537 and 3,294,540, French Pat. Nos. 1,491,805 and 1,596,673, JP-B-40-23466 and JP-A-50-156423, JP-A-54-18726 and JP-A-56-151933. Preferred examples include a condensate of a polyalkylene oxide consisting of at least 10 units of $C_{2-4}$ alkylene oxide such as ethylene oxide, propylene-1,2-oxide, and butylene-1,2-oxide, preferably ethylene oxide, with a compound containing at least one active hydrogen atom such as water, aliphatic alcohol, aromatic alcohol, aliphatic acid, organic amine, and hexitol derivative, and a block polymer of two or more polyalkylene oxides. Specific examples of such a polyalkylene oxide compound include polyalkylene glycol alkyl ethers, polyalkylene glycol aryl ethers, polyalkylene glycol alkyl aryl ethers, polyalkylene glycol esters, polyalkylene glycol aliphatic amides, polyalkylene glycol amines, polyalkylene glycol block copolymers, and polyalkylene glycol graft polymers. The polyalkylene oxide compound which can be used in the present invention generally has a molecular weight of from 300 to 15,000, preferably 600 to 8,000. The amount of the polyalkylene oxide compound to be incorporated in the emulsion is preferably in the range of 10 mg to 3 g per mol of silver halide. The polyalkylene oxide compound can be added to the emulsion at any step in the process of preparation of the emulsion.

The present silver halide emulsion may also comprise a compound for dispersing a coupler or a color coupler such as cyan coupler, magenta coupler, or yellow coupler therein.

It is preferred that the present silver halide emulsion also comprises a compound which undergoes an oxidation coupling with an aromatic primary amine developing agent (e.g., a phenylenediamine derivative and aminophenol derivative) to develop a color during the color development process. Examples of magenta couplers which can be incorporated in the present emulsion include 5-pyrazolone couplers, pyrazolobenzimidazole couplers, cyanoacetyl cumarone couplers, and open chain acylacetonitrile couplers. Examples of yellow couplers include acylacetamide couplers (e.g., benzoylacetanilides, and pivaloylacetanilides). Examples of cyan couplers include naphthol couplers and phenol couplers. These couplers are preferably nondiffusible couplers containing a hydrophobic group called a ballast group. These couplers may be 2-equivalent or 4-equivalent to silver ion. Alternatively, these couplers may be colored couplers having a color correcting effect or couplers which release a development inhibitor upon development (so-called DIR coupler).

Besides such a DIR coupler, there may be incorporated a colorless DIR coupling compound which gives a colorless product that releases a development inhibitor.

The silver halide photographic emulsion may also comprise a water-soluble dye (e.g., oxonol dye, hemioxonol dye, and merocyanine dye) as a filter dye or for the purpose of inhibiting irradiation or other various purposes.

The photographic emulsion may also comprise various surface active agents for various purposes such as facilitation of coating, improvement of lubricity, photographic properties (e.g., acceleration of development, increase of contrast, and sensitization) and emulsion dispersion, and inhibition of adhesion.

Examples of surface active agents include nonionic surface active agents such as saponin (steroid series), alkylene oxide derivatives (e.g., polyethylene glycol), polyethylene glycol alkyl ethers, glycidol derivatives, aliphatic esters of polyvalent alcohols, and alkyl esters of sugar; anionic surface active agents such as alkylcarbonates, alkylsulfonates, alkylbenzenesulfonates, and alkylsurfuric esters; and cationic surface active agents such as alkylamine salts, aliphatic or aromatic quaternary ammonium salts, pyridinium, imidazolium, and other heterocyclic quaternary ammonium salts. As a surface active agent to be used for an antistatic purpose, there may be preferably used a fluorine-containing surface active agent.

In one embodiment of the present invention, known discoloration inhibitors as described hereinafter may be used in combination with the above-described compounds or additives. In the present invention, dye stabilizers may be used singly or in combination. Examples of such known discoloration inhibitors include hydroquinone derivatives, gallic acid derivatives, p-alkoxyphenols, p-oxyphenol derivatives, and bisphenols.

The present photographic emulsion may also comprise an inorganic or organic film hardener. For example, chromium salts (e.g., chrome alum, acetic acid alum), aldehydes (e.g., formaldehyde, glyoxal, glutaraldehyde), active vinyl compounds (e.g., 1,3,5-triacryloyl-hexahydro-s-triazine, 1,3-vinylsulfonyl-2-propanol), and active halides (e.g., 2,4-dichloro-6-hydroxy-s-triazine) may be used singly or in combination.

The light-sensitive material prepared according to the present invention may also comprise a hydroquinone derivative, aminophenol derivative, gallic acid derivative or the like as a color for inhibitor.

The silver halide photographic emulsion of the present invention may also comprise as a protective colloid, gelatin, acylated gelatin such as phthalated gelatin or malonated gelatin, a cellulose compound such as hydroxyethyl cellulose or carboxymethyl cellulose, a soluble starch such as dextrin, a hydrophilic polymer such as polyvinyl alcohol, polyvinyl pyrrolidone, polyacrylamide or polystyrenesulfonic acid, a plasticizer for dimensional stability, a latex polymer, or a matt agent. The emulsion is then coated onto a proper support such as baryta paper, resin-coated paper, synthetic paper, triacetate film, polyethylene terephthalate film, other plastic base, or glass plate.

In order to obtain photographic images, the exposure may be effected by any known method. Particularly, various known light sources such as natural light (sunshine), tungsten lamp, fluorescent lamp, mercury vapor lamp, xenon arc lamp, carbon arc lamp, xenon flash lamp, laser, LED, and CRT can be used. The exposure time may be less than 1/1,000 second such as $1/10^4$ to $1/10^6$ second as in the case of xenon flash lamp or greater than 1 second, as well as an exposure time of from 1/1,000 to 1 second as normally used in a camera. The spectral composition of the light to be used in the exposure can be optionally adjusted by means of a color filter. Laser may be used for the exposure. The exposure may be effected with light emitted by a fluorescent substance which has been excited by electron beam, X-ray, γ-ray, α-ray or the like.

The present spectral sensitizing dyes can be used for the sensitization of a silver halide photographic emulsion for various color and black-and-white light-sensitive materials. Examples of such emulsions to which the present spectral sensitizing dyes can be applied include color positive emulsions, color negative emulsions, color paper emulsions, color reversal emulsions (which may optionally contain couplers), emulsions for printing photographic material (e.g., lith film), emulsions for CRT displaying light-sensitive materials, emulsions for silver salt diffusion transfer process, emulsions for color diffusion transfer process, emulsions for dye transfer process (imbitio transfer process) described in U.S. Pat. No. 2,882,156, emulsions for silver dye bleaching process, emulsions for materials for recording printout images (described in U.S. Pat. No. 2,369,449), emulsions for direct printing light-sensitive material (described in U.S. Pat. No. 3,033,682), and emulsions for heat developable color light-sensitive material.

The photographic processing of the light-sensitive material prepared according to the present invention can be accomplished by means of any suitable known method and processing solution as described in *Research Disclosure*, No. 17643 (pp. 28 to 30). The photographic processing may be either photographic processing for silver image formation (black-and-white processing) or photographic processing for dye formation (color photographic processing) depending on the purpose of application. The processing temperature can be normally selected from the range between 18° C. and 50° C. but may be lower than 18° C. or higher than 50° C.

Preferred embodiments of the present invention are as follows:

1. In the scope of the attached Claim 1, $R_l$, $R_2$, $R_3$ and $R_4$ each independently represents a benzothiazolyl-2-thio group, a naphthyl-2-oxy group, a phenoxyl group or a phenylthio group.
2. In embodiments-1, $B_2$ and $B_4$ in general formula (I) each represents =N—.
3. In the scope of the attached Claim 1, $m_1$ and $(l_1+n_1)$ in general formula (II) represent 0 and 2 or 3, respectively.
4. In the scope of the attached Claim 1, $l_1$, $m_1$ and $n_1$ in general formula (II) represent 1, 1, and 0, respectively.
5. In embodiment-3, $Z_1$ and $Z_2$ in general formula (I) each independently represent benzoxazole, naphthoxazole, benzothiazole, naphthothiazole, benzoselenazole, naphthoselenazole or benzimidazole.
6. In embodiment-4, $Q_1$ in general formula (II) represents azolinzine-4-one.

The present invention will be further described by reference to the following examples, but the present invention should not be construed as being limited thereto. Unless otherwise indicated, all parts, percents, weights, etc., are by weight.

EXAMPLE 1

A sulfur-sensitized halide emulsion consisting of 70 mol % of silver chloride, 29.5 mol % of silver bromide, and 0.5 mol % of silver iodide was prepared. The average diameter of the particulate silver halide was 0.35 μm. The emulsion thus prepared contained silver halide in an amount of 1.03 mol/kg.

The emulsion thus prepared was then measured out 1 kg each into several pots. Sensitizing dyes were then added to these samples as shown in Table 1-1 through Table 1-6. Ascorbic acid compounds and bisaminostilbene compounds were then added to the emulsion. The emulsion samples were then stirred at a temperature of 40° C. Further, 4-hydroxy-6-methyl-1,3,3*a*,7-tetraazaindene, 2,4-dichloro-6-hydroxy-1,3,5-triazine sodium, and sodium dodecylbenzenesulfonate were added to the emulsion in sequence in amounts of 0.2 g/kg, 0.1 g/kg and 0.1 g/kg, respectively. The emulsion samples each was then coated on a polyethylene terephthalate film base to obtain photographic light-sensitive materials.

These samples were then exposed to light from a tungsten lamp (2,854° K.) through an optical wedge, a blue filter (band pass filter which transmits light from 395 nm to 440 nm), and a red filter (band pass filter which transmits light having a wavelength longer than 600 nm) for 5 seconds.

After the exposure, these samples were then developed with a developing solution having the undermentioned composition at a temperature of 20° C. for 2 minutes. These samples were then measured by a Fuji Photo Film Co., Ltd.'s densitometer for density to determine red filter sensitivity (SR), blue filter sensitivity (SB) and fog. The reference point of optical density on which the sensitivity was determined was (fog+1.5).

| Composition of Developing Solution: | |
|---|---|
| Water | 700 ml |
| Methol | 3.1 g |
| Sodium Sulfite Anhydride | 45 g |
| Hydroquinone | 12 g |
| Sodium Carbonate (monohydrate) | 79 g |
| Potassium Bromide | 1.9 g |
| Water to make | 1 liter |

The developing solution thus obtained was diluted with water in a volume twice that of the solution before use.

The results thus obtained are shown as relative values in Tables 1-1 through 1-6.

TABLE 1-1

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | SR | SB | Fog | Remarks |
|---|---|---|---|---|---|---|---|
| 1 | — | — | — | | 100 | 0.04 | Comparison |
| 2 | — | — | (III-8) 0.8 | 100 | 17 | 0.04 | " |
| 3 | — | (I-12) 2 | (III-8) 0.8 | 230 | 28 | 0.05 | " |
| 4 | — | (I-12) 4 | (III-8) 0.8 | 234 | 34 | 0.05 | " |
| 5 | — | (I-12) 8 | (III-8) 0.8 | 246 | 29 | 0.05 | " |
| 6 | (A-2) 2 | — | (III-8) 0.8 | 138 | 17 | 0.05 | " |
| 7 | (A-2) 6 | — | (III-8) 0.8 | 145 | 17 | 0.05 | " |
| 8 | (A-2) 2 | (I-12) 2 | (III-8) 0.8 | 390 | 35 | 0.05 | Invention |

TABLE 1-1-continued

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | SR | SB | Fog | Remarks |
|---|---|---|---|---|---|---|---|
| 9 | (A-2) 6 | (I-12) 2 | (III-8) 0.8 | 490 | 36 | 0.05 | " |
| 10 | (A-2) 2 | (I-12) 4 | (III-8) 0.8 | 426 | 35 | 0.05 | " |
| 11 | (A-2) 6 | (I-12) 4 | (III-8) 0.8 | 490 | 37 | 0.05 | " |

TABLE 1-2

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | SR | SB | Fog | Remarks |
|---|---|---|---|---|---|---|---|
| 1 | — | — | (III-4) 0.8 | 100 | 47 | 0.04 | Comparison |
| 2 | — | (I-16) 4 | (III-4) 0.8 | 126 | 69 | 0.04 | " |
| 3 | (A-1) 2 | — | (III-4) 0.8 | 138 | 65 | 0.04 | " |
| 4 | (A-1) 6 | — | (III-4) 0.8 | 141 | 66 | 0.04 | " |
| 5 | (A-1) 2 | (I-16) 4 | (III-4) 0.8 | 191 | 83 | 0.04 | Invention |
| 6 | (A-1) 6 | (I-16) 4 | (III-4) 0.8 | 195 | 83 | 0.04 | " |

TABLE 1-3

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | SR | SB | Fog | Remarks |
|---|---|---|---|---|---|---|---|
| 1 | — | — | (II-7) 0.8 | 100 | 63 | 0.04 | Comparison |
| 2 | — | (I-12) 4 | (II-7) 0.8 | 276 | 73 | 0.04 | " |
| 3 | (A-1) 2 | — | (II-7) 0.8 | 129 | 76 | 0.05 | " |
| 4 | (A-1) 6 | — | (II-7) 0.8 | 126 | 76 | 0.05 | " |
| 5 | (A-1) 2 | (I-12) 4 | (II-7) 0.8 | 372 | 91 | 0.04 | Invention |
| 6 | (A-1) 6 | (I-12) 4 | (II-7) 0.8 | 380 | 93 | 0.04 | " |
| 7 | — | (I-9) 4 | (II-7) 0.8 | 245 | 66 | 0.04 | Comparison |
| 8 | (A-1) 2 | (I-9) 2 | (II-7) 0.8 | 347 | 85 | 0.04 | Invention |
| 9 | (A-1) 6 | 4 | (II-7) 0.8 | 347 | 87 | 0.07 | " |

TABLE 1-4

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | SR | SB | Fog | Remarks |
|---|---|---|---|---|---|---|---|
| 1 | — | — | (III-2) 0.4 | 100 | 42 | 0.04 | Comparison |
| 2 | — | (I-4) 4 | (III-2) 0.4 | 135 | 50 | 0.04 | " |
| 3 | (A-5) 2 | — | (III-2) 0.4 | 117 | 48 | 0.04 | " |
| 4 | (A-5) 6 | — | (III-2) 0.4 | 123 | 51 | 0.04 | " |
| 5 | (A-5) 2 | (I-4) 4 | (III-2) 0.4 | 178 | 60 | 0.04 | Invention |
| 6 | (A-5) 6 | (I-4) 4 | (III-2) 0.4 | 191 | 63 | 0.04 | " |

TABLE 1-5

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | Compound Used for Comparison and Its Amount of Use ($\times 10^{-4}$ mol/kg emulsion) | SR | SB | Fog | Remarks |
|---|---|---|---|---|---|---|---|---|
| 1 | — | — | (III-3) 0.8 | — | 100 | 45 | 0.04 | Comparison |
| 2 | — | (I-15) 4 | (III-3) 0.8 | — | 132 | 66 | 0.04 | " |
| 3 | (A-3) 2 | — | (III-3) 0.8 | — | 135 | 56 | 0.04 | " |
| 4 | (A-3) 6 | — | (III-3) 0.8 | — | 138 | 56 | 0.04 | " |
| 5 | (A-3) 2 | (I-15) 4 | (III-3) 0.8 | — | 186 | 80 | 0.04 | Invention |
| 6 | (A-3) 6 | (I-15) 4 | (III-3) 0.8 | — | 195 | 81 | 0.04 | " |
| 7 | (A-3) 2 | — | (III-3) 0.8 | (X-1) 2 | 145 | 59 | 0.04 | Comparison |
| 8 | (A-3) 2 | — | (III-3) 0.8 | 4 | 153 | 62 | 0.04 | " |

TABLE 1-6

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | SR | SB | Fog | Remarks |
|---|---|---|---|---|---|---|---|
| 1 | — | — | (II-11) 0.4 | 100 | 31 | 0.03 | Comparison |
| 2 | — | (I-14) 2 | (II-11) 0.4 | 690 | 33 | 0.03 | " |
| 3 | — | (I-14) 4 | (II-11) 0.4 | 793 | 74 | 0.03 | " |
| 4 | — | (I-14) 8 | (II-11) 0.4 | 760 | 66 | 0.03 | " |
| 5 | (A-2) 2 | — | (II-11) 0.4 | 148 | 58 | 0.03 | " |
| 6 | (A-2) 6 | — | (II-11) 0.4 | 158 | 41 | 0.03 | " |
| 7 | (A-2) 2 | (I-14) 2 | (II-11) 0.4 | 1,122 | 94 | 0.03 | Invention |
| 8 | (A-2) 6 | (I-14) 2 | (II-11) 0.4 | 1,260 | 107 | 0.03 | " |
| 9 | (A-2) 2 | (I-14) 8 | (II-11) 0.4 | 1,050 | 96 | 0.03 | " |
| 10 | (A-2) 6 | (I-14) 8 | (II-11) 0.4 | 1,260 | 105 | 0.03 | " |

COMPOUND USED FOR COMPARISON

X-1: 4,4'-Bis(4,6-dihydroxy-1,3,5-triazine-2-yl-amino)-stilbene-2,2'-disulfonic acid.

The results in Example 1 show that the combined use of an ascorbic acid compound, a bisaminostilbene compound substituted by a pyrimidine derivative and a sensitizing dye improves the inhibition of desensitization due to sensitizing dye, i.e., so-called dye desensitization (SB), entailing an increase in spectral sensitivity (SR). This effect is much greater than when either an ascorbic acid compound or a bisaminostilbene compound substituted by a pyrimidine derivative alone is used in combination with a sensitizing dye.

Table 1-5 shows the results obtained when the bisaminostilbene compound according to the present invention was replaced by the compound (X-1) described in U.S. Pat. No. 3,695,888. The results show that the positive effect of a bisaminostilbene compound substituted by a pyrimidine derivative on SB and SR is much greater than that of a bisaminostilbene compound substituted by a triazine derivative.

EXAMPLE 2

A sulfur-sensitized silver halide emulsion comprising cubic particles or pure silver bromide was prepared. The average particle diameter of particulate silver halide contained in the emulsion was 0.8 μm. The emulsion contained silver halide in an amount of 0.6 mol/kg.

The emulsion thus obtained was the measured out 1 kg each into several pots. Sensitizing dyes were then added to these samples as shown in Table 2-1 through Table 2-6. Ascorbic acid compounds and bisaminostilbene compounds were then added to these samples. These samples were stirred at a temperature of 40° C. Further, 4-hydroxy-6-methyl-1,3,3*a*,7-tetraazaindene, 2,4-dichloro-6-hydroxy-1,3,5-triazine sodium and sodium dodecylbenzenesulfonate were added to these samples in sequence in amounts of 0.1 g/kg, respectively. The emulsions thus prepared each was then each coated on a polyethylene terephthalate film base to prepare photographic materials.

These samples each was exposed to light from a tungsten lamp (2,854° K.) through an optical wedge and the same blue and red filters as used in Example 1 for 1 second.

After the exposure, these samples were then developed with the same developing solution as used in Example 1 at a temperature of 20° C. for 4 minutes. The samples thus developed were then measured by a Fuji Photo Film Co., Ltd.'s densitometer for density to determine red filter sensitivity (SR), blue filter sensitivity (SB) and fog. The reference point of optical density on which the spectral sensitivity was determined was (fog+0.2).

The results thus obtained are shown as relative values in Table 2-1 through Table 2-6.

TABLE 2-1

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | Compound Used for Comparison and Its Amount of Use ($\times 10^{-4}$ mol/kg emulsion) | SR | SB | Fog | Remarks |
|---|---|---|---|---|---|---|---|---|
| 1 | — | — | — | — | — | 100 | 0.04 | Comparison |
| 2 | — | — | (II-19) 0.8 | — | 100 | 7 | 0.04 | " |
| 3 | — | (I-12) 2 | (II-19) 0.8 | — | 500 | 7 | 0.04 | " |
| 4 | — | (I-12) 6 | (II-19) 0.8 | — | 890 | 14 | 0.04 | " |
| 5 | — | (I-12) 18 | (II-19) 0.8 | — | 955 | 14 | 0.04 | " |
| 6 | (A-1) 0.3 | — | (II-19) 0.8 | — | 246 | 20 | 0.04 | " |
| 7 | (A-1) 1 | — | (II-19) 0.8 | — | 191 | 15 | 0.04 | " |
| 8 | (A-1) 3 | — | (II-19) 0.8 | — | 182 | 14 | 0.04 | " |
| 9 | (A-1) 0.3 | (I-12) 6 | (II-19) 0.8 | — | 1,740 | 36 | 0.04 | Invention |
| 10 | (A-1) 1 | (I-12) 6 | (II-19) 0.8 | — | 1,905 | 42 | 0.04 | " |
| 11 | (A-1) 3 | (I-12) 6 | (II-19) 0.8 | — | 1,700 | 36 | 0.04 | " |
| 12 | (A-1) 0.3 | — | (II-19) 0.8 | (X-1) 6 | 1,100 | 18 | 0.04 | Comparison |
| 13 | (A-1) 1 | — | (II-19) 0.8 | (X-1) 6 | 1,200 | 19 | 0.04 | " |
| 14 | (A-1) 3 | — | (II-19) 0.8 | (X-1) 6 | 1,200 | 19 | 0.04 | " |

TABLE 2-2

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | SR | SB | Fog | Remarks |
|---|---|---|---|---|---|---|---|
| 1 | — | — | (II-2) 0.2 | 100 | 2 | 0.04 | Comparison |
| 2 | — | (I-14) 6 | (II-2) 0.2 | 1,175 | 14 | 0.04 | " |
| 3 | — | (I-14) 18 | (II-2) 0.2 | 1,120 | 15 | 0.04 | " |
| 4 | (A-5) 4 | — | (II-12) 0.2 | 214 | 5 | 0.04 | " |
| 5 | (A-5) 4 | (I-14) 6 | (II-12) 0.2 | 2,090 | 27 | 0.04 | Invention |
| 6 | (A-5) 4 | (I-14) 18 | (II-12) 0.2 | 1,860 | 29 | 0.04 | " |

TABLE 2-3

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | SR | SB | Fog | Remarks |
|---|---|---|---|---|---|---|---|
| 1 | — | — | (II-5) 0.8 | 100 | 16 | 0.05 | Comparison |
| 2 | — | (I-10) 10 | (II-5) 0.8 | 186 | 23 | 0.05 | " |
| 3 | (A-5) 4 | — | (II-5) 0.8 | 144 | 22 | 0.05 | " |
| 4 | (A-5) 4 | (I-10) 10 | (II-5) 0.8 | 282 | 37 | 0.05 | Invention |

TABLE 2-4

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | SR | SB | Fog | Remarks |
|---|---|---|---|---|---|---|---|
| 1 | — | — | (II-8) 0.4 | 100 | 7 | 0.04 | Comparison |
| 2 | — | (I-3) 10 | (II-8) 0.4 | 1,050 | 28 | 0.04 | " |
| 3 | (A-4) 4 | — | (II-8) 0.4 | 234 | 18 | 0.04 | " |
| 4 | (A-4) 4 | (I-3) 10 | (II-8) 0.4 | 1,910 | 46 | 0.04 | Invention |

TABLE 2-5

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | SR | SB | Fog | Remarks |
|---|---|---|---|---|---|---|---|
| 1 | — | — | (III-12) 0.3 | 100 | 7 | 0.04 | Comparison |
| 2 | — | (I-19) 6 | (III-12) 0.3 | 282 | 9 | 0.04 | " |
| 3 | — | 18 | (III-12) 0.3 | 257 | 9 | 0.04 | " |
| 4 | (A-4) 4 | — | (III-12) 0.3 | 123 | 7 | 0.04 | " |
| 5 | (A-4) 4 | (I-9) 6 | (III-12) 0.3 | 355 | 10 | 0.04 | Invention |
| 6 | (A-4) 4 | 18 | (III-12) 0.3 | 339 | 10 | 0.04 | " |

TABLE 2-6

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | SR | SB | Fog | Remarks |
|---|---|---|---|---|---|---|---|
| 1 | — | — | (II-15) 0.4 | 100 | 8 | 0.04 | Comparison |
| 2 | — | (I-15) 10 | (II-15) 0.4 | 890 | 17 | 0.04 | " |
| 3 | (A-4) 4 | — | (II-15) 0.4 | 270 | 16 | 0.04 | " |
| 4 | (A-4) 4 | (I-15) 10 | (II-15) 0.4 | 1,590 | 32 | 0.04 | Invention |

It will be appreciated from the results in Example 2 that the present invention provides for a great improvement in the inhibition of dye desensitization and a sensitizing effect which surpasses this improvement. For example, Table 2-1 shows that the use of ascorbic acid (A-1) provides a red sensitivity (SR) 2.4 times that of the comparative samples and the use of a bisaminostilbene compound (I-12) provides a red sensitivity 9.5 times that of the comparative samples. Furthermore, the combined use of both the compounds and the sensitizing dye (II-19) provides a red sensitivity 19 times that of the comparative samples. However, even a bisaminostilbene compound may provide a remarkably poor sensitizing effect if it is a compound substituted by a triazine derivative which does not fall within the scope of the present invention (Compound X-1).

EXAMPLE 3

A silver halide emulsion was prepared as follows.

| | |
|---|---|
| Solution 1 | |
| $H_2O$ | 1,000 ml |
| NaCl | 5.5 g |
| Gelatin | 32 g |
| Solution 2 | |
| Sulfuric Acid (1 N) | 24 ml |
| Solution 3 | |
| 1% Solution of the following silver halide solvent: | 3 ml |

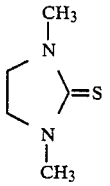

| | |
|---|---|
| Solution 4 | |
| KBr | 15.66 g |
| NaCl | 3.30 g |
| $H_2O$ to make | 200 ml |
| Solution 5 | |
| $AgNO_3$ | 32 g |
| $H_2O$ to make | 200 ml |
| Solution 6 | |
| KBr | 62.72 g |
| NaCl | 13.22 g |
| $K_2IrCl_6$ (0.001%) | 4.54 ml |
| $H_2O$ to make | 600 ml |
| Solution 7 | |
| $AgNO_3$ | 128 g |
| $H_2O$ to make | 600 ml |

Solution 1 was heated to a temperature of 56° C. Solutions 2 and 3 were then added to Solution 1 thus heated. Solutions 4 and 5 were simultaneously added to the solution mixture in 30 minutes. After 5 minutes passed, the temperature of the solution was lowered. The solution was then desalted. Water and dispersed gelatin were then added to the solution. The pH value of the solution was adjusted to 6.2 to prepare a monodisperse emulsion of cubic particulate silver bromochloride having an average particle size of 0.45 μm and containing 70 mol % of silver bromide. The emulsion thus prepared was then subjected to optimum chemical sensitization with $1.0\times10^{-4}$ mol/mol Ag of chloroauric acid and sodium thiosulfate.

A sensitizing dye (III-14) was then added to the emulsion in an amount of $1.2\times10^{-4}$ mol/mol AgX. L-Ascorbic acid (A-1) and a bisaminostilbene compound (I-12) were then added to the emulsion in amounts of $1.0\times10^{-3}$ mol/mol AgX and $4\times10^{-4}$ mol/mol AgX, respectively, with stirring. The emulsion thus prepared was then stored at a temperature of 40° C. for 30 minutes. Couplers shown in Table 3-1 were then added to the emulsion with stirring to prepare a coating solution sample. For comparison, samples free of either (A-1) or (I-12) were prepared. These samples were then each coated on a paper support laminated with polyethylene on both sides thereof in the manner as described hereinafter.

The coated amount was adjusted so that the amount of silver and gelatin were 0.35 g/m² and 1.5 g/m², respectively. A protective layer comprising 1.5 g/m² of gelatin was provided on the top of the coat. As gelatin hardeners there were prepared two coating samples comprising 2,4-dichloro-6-hydroxy-1,3,5-triazine sodium salt and 1,3-bis (vinylsulfonyl)-2-propanol, respectively.

These samples were then exposed to light from a tungsten lamp (3,200° K.) through the same red filter as used in Example 1 for 0.5 second. These samples were then developed with a color developing solution having the following composition:

| | |
|---|---|
| Composition of Color Developing Solution: | |
| Water | 800 ml |
| Pentasodium Diethylenetriaminepenta-acetate | 2.0 g |
| Benzyl Alcohol | 15 ml |
| Diethylene Glycol | 10 ml |
| $Na_2SO_3$ | 2.0 g |
| KBr | 1.0 g |
| Hydroxylamine Sulfate | 3.0 g |
| 4-Amino-3-methyl-N—ethyl-N—[β-(methane-sulfonamido)ethyl]-p-phenylenediamine Sulfate | 5.0 g |
| $Na_2CO_3$ (monohydrate) | 30.0 g |
| Fluorescent Brightening Agent (stilbene-based) | 1.0 g |
| Water to make | 1,000 ml |
| pH | 10.2 |
| Composition of Blix Solution: | |
| Ammonium Thiosulfate (54 wt %) | 150 ml |
| $Na_2SO_3$ | 15 g |
| $NH_4$[Fe(III)(EDTA)] | 55 g |
| EDTA.2Na | 4 g |
| Glacial Acetic Acid | 8.61 g |
| Water to make | 1,000 ml |
| pH | 5.4 |
| Composition of Rinse Solution: | |
| EDTA.2Na.$2H_2O$ | 0.4 g |
| Water to make | 1,000 ml |
| pH | 7.0 |

The processing conditions were as follows:

| Processing Step | Temperature (°C.) | Time |
|---|---|---|
| Development | 33 | 3 min 30 sec |
| Blix | " | 1 min 30 sec |
| Rinse | 28–35 | " |

The evaluation of the photographic properties of these samples was represented as a relative sensitivity with the sensitivity of the sample free of L-ascorbic acid (A-1) and bisaminostilbene compound (I-12) taken as 100. The reference point of optical density on which the spectral sensitivity was determined was (fog+0.5).

TABLE 3-1

| Test No. | Coupler and Its Coated Amount (g/m²) | Relative Sensitivity | Fog | |
|---|---|---|---|---|
| 3-1 | (C-1) 0.3 | 282 | 0.13 | Magenta Coupler |
| 3-2 | (C-2) 0.3 | 288 | 0.13 | " |
| 3-3 | (C-3) 0.3 | 282 | 0.14 | " |
| 3-4 | (C-4) 0.3 | 302 | 0.14 | " |
| 3-5 | (C-5) 0.3 | 269 | 0.08 | Cyan Coupler |
| 3-6 | (C-6) 0.3 | 309 | 0.08 | " |
| 3-7 | (C-7) 0.3 | 295 | 0.09 | " |
| 3-8 | (C-8) 0.7 | 302 | 0.12 | Yellow Coupler |

Table 3-1 shows the results of the sample comprising 1,3-bis(vinylsulfonyl)-2-propanol as a gelatin hardener. The sample comprising 2,4-dichloro-6-hydroxy-1,3,5-triazine sodium salt gave the similar results. Table 3-1 shows that the combined use of ascorbic acid and a bisaminostilbene compound substituted by a pyrimidine derivative can improve the spectral sensitivity. It is also shown that this effect remains the same even when different couplers are used.
Chemical Structure of Coupler Used:
(C-1)
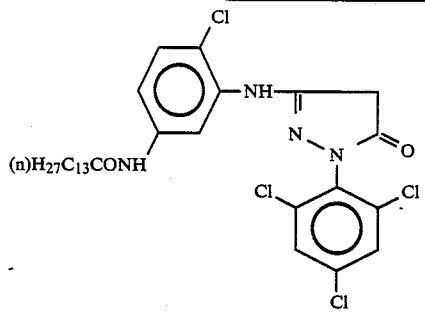
(C-2)
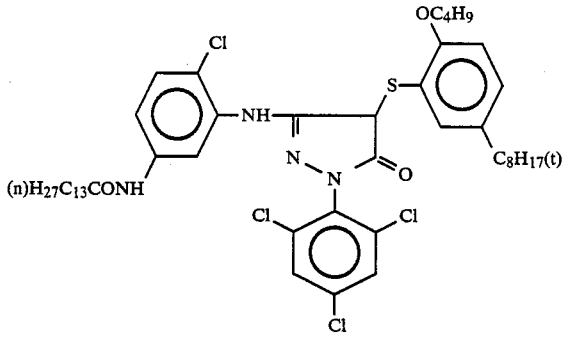
(C-3)
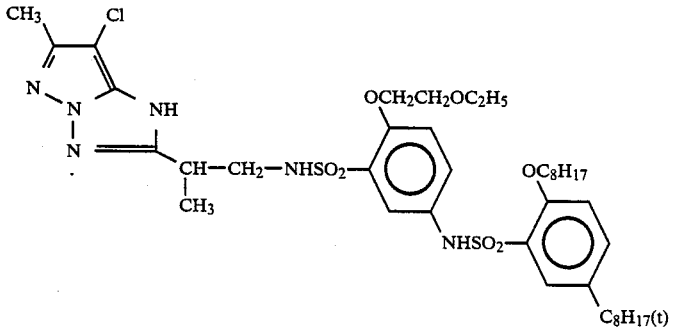
(C-4)
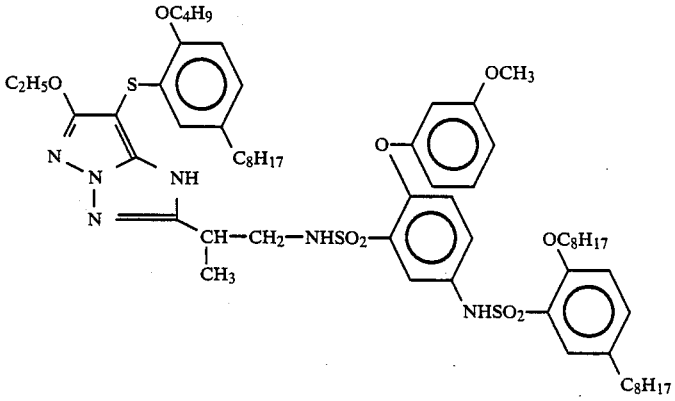
(C-5)
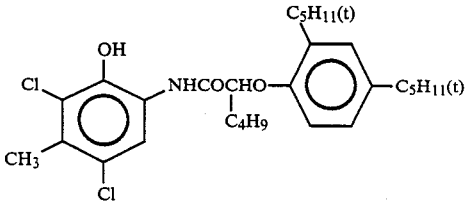

-continued

Chemical Structure of Coupler Used:

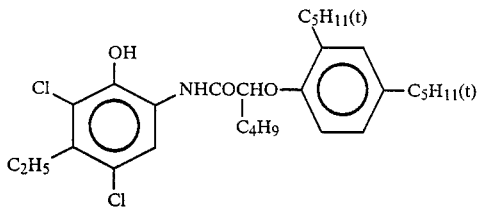

(C-6)

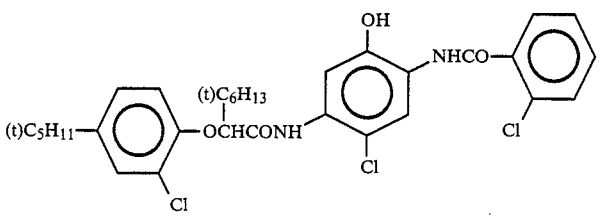

(C-7)

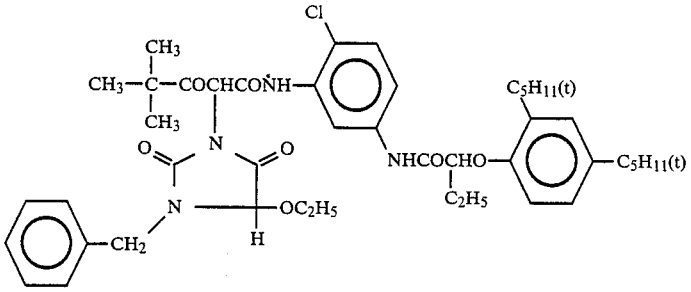

(C-8)

EXAMPLE 4

The present and comparative photographic light-sensitive material samples were prepared with the same silver halide photographic emulsion as used in Example 1 in the same manner as used in Example 1. Some of these photographic light-sensitive material samples were subjected to exposure and development under the same conditions as in Example 1, five days after coating. The rest of the samples were stored at a temperature of 25° C. and a relative humidity of 60% for 6 months and then developed under the same conditions as in Example 1. The results are shown as relative values in Table 4. Table 4 shows that the present samples exhibited less deterioration in spectral sensitivity and less increase in fog than the comparative samples.

EXAMPLE 5

A monodisperse emulsion of cubic particulate silver chloride was prepared in the same manner as in Example 3 except that the composition of Solutions 4 and 6 were changed as described hereinafter and the addition of Solutions 4, 5, 6 and 7 was made in a shorter time.

| | |
|---|---|
| Solution 4 | |
| NaCl | 11.00 g |
| $H_2O$ to make | 200 ml |
| Solution 6 | |
| NaCl | 44.05 g |
| $K_2IrCl_6$ (0.001%) | 4.54 ml |
| $H_2O$ to make | 600 ml |

TABLE 4

| Test No. | Ascorbic Acid Compound and Its Amount of Use ($\times 10^{-3}$ mol/kg emulsion) | Compound (I) and Its Amount of Use ($\times 10^{-4}$ mol/kg emulsion) | Sensitizing Dye and Its Amount of Use ($\times 10^{-4}$ mol/kg emulsion) | ΔSR | ΔSB | ΔFog | Remarks |
|---|---|---|---|---|---|---|---|
| 1 | — | — | — | — | 110 | 0 | |
| 2 | — | — | (II-11) 0.4 | 35 | 36 | +0.01 | Comparison |
| 3 | (A-3) 2 | (I-12) 4 | (II-11) 0.4 | 81 | 80 | 0 | Invention |
| 4 | — | — | (II-8) 0.2 | 40 | 71 | 0 | Comparison |
| 5 | (A-2) 2 | (I-14) 4 | (II-8) 0.2 | 71 | 83 | 0 | Invention |
| 6 | — | — | (III-1) 0.8 | 69 | 73 | +0.02 | Comparison |
| 7 | (A-2) 2 | (I-15) 4 | (III-1) 0.8 | 98 | 100 | 0 | Invention |
| 8 | — | — | (III-10) 0.4 | 76 | 59 | +0.05 | Comparison |
| 9 | (A-4) 2 | (I-14) 4 | (III-10) 0.4 | 87 | 69 | +0.02 | Invention |

ΔSR and ΔSB are represented by the sensitivity obtained after 6 month storage, with the value of the sample which has been processed 5 days after coating taken as 100.

ΔFog is represented by (fog obtained after 6 month storage) − (fog obtained 5 days after coating).

The emulsion particles thus obtained had an average particle size of 0.45 μm and a size variation coefficient of 0.8 (as determined by dividing the standard deviation (S) by the average particle size (d): S/d). The pH value of the emulsion was adjusted to 6.2 and the pAg value of the emulsion was adjusted to 7.3. The emulsion was then subjected to optimum chemical sensitization with sodium thiosulfate.

The emulsion thus obtained was then used to prepare several samples. A sensitizing dye (II-21) was then added to these samples in an amount of $1.06\times10^{-4}$ mol per mol of silver as shown in Table 5. Bisaminostilbene compound (I-12) and/or L-ascorbic acid (A-1) were added to the samples. These samples each was then coated on a polyethylene terephthalate film support in the same manner as in Example 1.

These samples each was then exposed to light through an ultraviolet light transmission filter (band pass filter which transmits light from 290 nm to 400 nm with a transmission peak wavelength of 347 nm) and a red sharp cut filter (filter which transmits light having a wavelength longer than 600 nm) in the same manner as in Example 1. These samples were then developed in the same manner as in Example 1. These samples were then measured by a Fuji Photo Film Co., Ltd.'s densitometer for density to determine sensitivity with a red filter (SR), sensitivity with an ultraviolet light transmission filter (SB), and fog. The sensitivity is determined as reciprocal of the light amount required to give an optical density of (fog+0.2). In Table 5, the sensitivity values are shown as relative to that of Sample 1 taken as 100.

COMPOUND USED FOR COMPARISON

X-2: 4,4'-Bis(4,6-dianilino-1,3,5-triazine-2-yl-amino) stilbene-2,2'-disodium disulfonate.

TABLE 5

| Test No. | Ascorbic Acid Compound and Its Amount of Use ($\times 10^{-3}$ mol/mol silver) | Compound (I) and Its Amount of Use ($\times 10^{-3}$ mol/mol silver) | Sensitizing Dye and Its Amount of Use ($\times 10^{-4}$ mol/mol silver) | Compound Used for Comparison and Its Amount of Use ($\times 10^{-3}$ mol/mol silver) | SR | SB | Fog | Remarks |
|---|---|---|---|---|---|---|---|---|
| 1 | — | — | (II-21) 1.06 | — | 100 | 100 | 0.06 | Comparison |
| 2 | (A-1) 2.12 | — | (II-21) 1.06 | — | 179 | 170 | 0.06 | " |
| 3 | (A-1) 4.24 | — | (II-21) 1.06 | — | 186 | 174 | 0.09 | " |
| 4 | — | (I-12) 0.85 | (II-21) 1.06 | — | 501 | 316 | 0.06 | " |
| 5 | — | (I-12) 2.12 | (II-21) 1.06 | — | 501 | 229 | 0.05 | " |
| 6 | (A-1) 2.12 | (I-12) 0.85 | (II-21) 1.06 | — | 759 | 398 | 0.06 | Invention |
| 7 | (A-1) 2.12 | (I-12) 2.12 | (II-21) 1.06 | — | 724 | 316 | 0.06 | " |
| 8 | (A-1) 4.24 | (I-12) 0.85 | (II-21) 1.06 | — | 794 | 479 | 0.06 | " |
| 9 | (A-1) 4.24 | (I-12) 2.12 | (II-21) 1.06 | — | 813 | 355 | 0.07 | " |
| 10 | — | — | (II-21) 1.06 | (X-2) 0.85 | 398 | 200 | 0.06 | Comparison |
| 11 | — | — | (II-21) 1.06 | (X-2) 2.12 | 257 | 115 | 0.06 | " |
| 12 | (A-1) 2.12 | — | (II-21) 1.06 | (X-2) 0.85 | 479 | 269 | 0.06 | " |
| 13 | (A-1) 2.12 | — | (II-21) 1.06 | (X-2) 2.12 | 331 | 158 | 0.07 | " |

Table 5 shows that the present process provides a drastic improvement in the inhibition of dye desensitization, resulting in a remarkable increase in spectral sensitivity.

It will be also be appreciated that while the combined use of the bis(triazylamino)stilbene compound and L-ascorbic acid exhibits the effect of increasing SR only by 1.2 to 1.3 times, the combined use of the present bis(pyrimidylamino)stilbene compound and L-ascorbic acid exhibits an effect of increasing SR by 1.5 or more times, thus providing an extremely high sensitivity.

Thus, the present invention enables an improvement in the inhibition of desensitization due to a red-sensitive sensitizing dye by providing a silver halide photographic emulsion having a remarkably high red sensitivity. Such an emulsion exhibits excellent storage stability and exhibits little residual color.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion, which comprises a silver halide emulsion;

at least one ascorbic acid compound;

at least one compound represented by general formula (I):

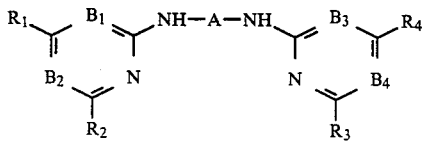

(I)

wherein

A represents a divalent aromatic residual group;

$R_1$, $R_2$, $R_3$ and $R_4$ each independently represents a hydrogen atom, a hydroxyl group, an alkyl group, an alkoxyl group, an aryloxyl group, a halogen atom, a heterocyclic nucleus, an allylthio group, a heterocyclylthio group, an arylthio group, an amine group, a substituted or unsubstituted alkylamino group, a substituted or unsubstituted arylamino group, a heterocyclylamino group, or a substituted or unsubstituted aralkylamino group, a substituted or unsubstituted aryl group or a mercapto group; and $B_1$, $B_2$, $B_3$, and $B_4$ each independently represents —CH= or —N=, with the proviso that at least one of A, $R_1$, $R_2$, $R_3$ and $R_4$ contains a sulfonyl group, that one of $B_1$ and $B_2$ represents —CH= and the other represents —N=, and that one of $B_3$ and $B_4$ represents —CH= and the other represents —N=; and at least one sensitizing dye of general formula (II) and general formula (III) at least one sensitizing dye of:

(II)

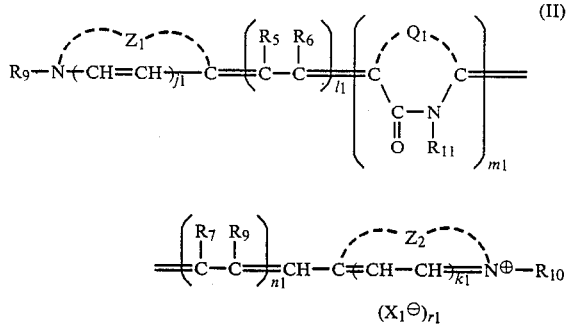

wherein $Z_1$ and $Z_2$, which may be the same or different, each represents a 5- or 6-membered nitrogen-containing heterocycle-forming atomic group;

$Q_1$ represents a 5- or 6-membered nitrogen-containing ketomethylene ring-forming atomic group;

$R_5$, $R_6$, $R_7$ and $R_8$ each independently represents a hydrogen atom, a lower alkyl group, or a phenyl group or aralkyl group, either or both of which may be substituted;

$R_9$ and $R_{10}$ each independently represents an alkyl group or alkenyl group, either of which may contain one or more oxygen atoms, sulfur atoms and/or nitrogen atoms in a carbon chain and which may be substituted;

$R_{11}$ has the same meaning as $R_9$ or represents an aryl group or a 5- or 6-membered heterocyclic group;

$l_1$ represents 1;

$n_1$ represents 0;

$R_5$ and $R_9$ may be connected to each other to form, together with the adjacent atoms, a 5- or 6-membered ring;

$j_1$ and $k_1$ each independently represents an integer of 0 or 1;

$m_1$ represents 1;

$X_1$ represents an acid anion; and $r_1$ represents 0 or 1;

(III)

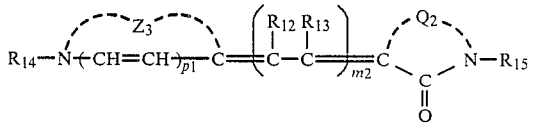

wherein $Z_3$ represents a 5- or 6-membered nitrogen-containing heterocycle-forming atomic group;

$Q_2$ represents a 5-or 6-membered nitrogen-containing ketomethylene ring-forming atomic group;

$R_{12}$ represents a hydrogen atom or an alkyl group;

$R_{13}$ represents a hydrogen atom or a phenyl group or an alkyl group, either or both of which may be substituted;

$R_{14}$ represents an alkyl or alkenyl group, either of which may contain one or more oxygen atoms, sulfur atoms and/or nitrogen atoms in a carbon chain or may be substituted;

$R_{15}$ has the same meaning as $R_{14}$, or represents a hydrogen atom or a monocyclic aryl group or a 5- or 6-membered monoheterocyclic group which may be substituted;

$m_2$ represents 2 or 3, with the proviso that two $R_{13}$'s may be connected to each other to form, together with the adjacent atoms, a 5- or 6-membered ring which may contain one or more oxygen atoms, sulfur atoms and/or nitrogen atoms; and $P_1$ represents 0 or 1, with the proviso that $R_{12}$ and $R_{14}$ may be connected to each other to form, together with the adjacent atoms, a 5- or 6-membered ring.

2. A silver halide photographic emulsion as claimed in claim 1, wherein $R_1$, $R_2$, $R_3$ and $R_4$ each independently represents a benzothiazolyl-2-thio group, a naphthyl-2-oxy group, a phenoxyl group or a phenylthio group.

3. A silver halide photographic emulsion as claimed in claim 1, wherein $Q_1$ represents azolizine-4-one.

* * * * *